US012227338B2

(12) United States Patent
Bullock et al.

(10) Patent No.: US 12,227,338 B2
(45) **Date of Patent: *Feb. 18, 2025**

(54) CONTAINER AND LATCHING SYSTEM

(71) Applicant: YETI Coolers, LLC, Austin, TX (US)

(72) Inventors: Dustin R. Bullock, Austin, TX (US); Colin Darling, Austin, TX (US); Walter T. Blanchard, Manor, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/218,838

(22) Filed: Jul. 6, 2023

(65) Prior Publication Data

US 2024/0010396 A1 Jan. 11, 2024

Related U.S. Application Data

(63) Continuation of application No. 17/530,053, filed on Nov. 18, 2021, now Pat. No. 11,738,914.

(51) Int. Cl.
*B65D 43/16* (2006.01)
*B65D 1/24* (2006.01)
(Continued)

(52) U.S. Cl.
CPC ..... *B65D 43/165* (2013.01); *B65D 1/24* (2013.01); *B65D 25/04* (2013.01); *B65D 25/22* (2013.01); *B65D 25/2873* (2013.01); *B65D 43/22* (2013.01); *B65D 45/20* (2013.01); *B65D 55/02* (2013.01); *B65D 77/046* (2013.01); *B65D 2525/287* (2013.01); *B65D 2543/00194* (2013.01); *B65D 2543/00296* (2013.01);
(Continued)

(58) Field of Classification Search
CPC ..... B65D 43/22; B65D 43/267; B65D 2525/287; B65D 43/165; B65D 1/24; B65D 25/04; B65D 25/22; B65D 25/2873; B65D 45/20; B65D 55/02; B65D 77/046; B65D 2543/00194; B65D 2543/00296; B65D 2543/00518; B65D 2543/00537; B65D 2543/00555; B65D 2543/0087; B65D 2543/00972; B65D 2577/041
See application file for complete search history.

(56) References Cited

U.S. PATENT DOCUMENTS 2,784,992 A 3/1957 Karjala
2,883,041 A 4/1959 Pfeifer et al.
(Continued)

FOREIGN PATENT DOCUMENTS

AU 712724 B3 11/1999
AU 2020100790 A4 6/2020
(Continued)

OTHER PUBLICATIONS

US 11,511,919 B2, 08/2022, Guo (withdrawn)
(Continued)

*Primary Examiner* — Shawn M Braden
(74) *Attorney, Agent, or Firm* — Banner & Witcoff, Ltd.

(57) ABSTRACT

A container is disclosed that has a base and a lid that is rotatable about a hinge from a closed configuration to an open configuration. The lid may be secured to the base with a latch assembly. A latch assembly may have a locked position and an unlocked position.

20 Claims, 16 Drawing Sheets

(51) Int. Cl.

| | |
|---|---|
| ***B65D 25/04*** | (2006.01) |
| ***B65D 25/22*** | (2006.01) |
| ***B65D 25/28*** | (2006.01) |
| ***B65D 43/22*** | (2006.01) |
| ***B65D 45/20*** | (2006.01) |
| ***B65D 55/02*** | (2006.01) |
| ***B65D 77/04*** | (2006.01) |

(52) U.S. Cl.

CPC ..... *B65D 2543/00518* (2013.01); *B65D 2543/00537* (2013.01); *B65D 2543/00555* (2013.01); *B65D 2543/0087* (2013.01); *B65D 2543/00972* (2013.01); *B65D 2577/041* (2013.01)

(56) References Cited

U.S. PATENT DOCUMENTS

| | | | |
|---|---|---|---|
| 3,583,556 | A | 6/1971 | Wagner |
| 3,825,110 | A | 7/1974 | Halbich et al. |
| 4,040,518 | A | 8/1977 | Carter |
| 4,102,452 | A | 7/1978 | Sato et al. |
| 4,276,893 | A | 7/1981 | Enomoto et al. |
| 4,331,168 | A | 5/1982 | Hatakeyama |
| 4,344,646 | A | 8/1982 | Michel |
| 4,366,829 | A | 1/1983 | Yuhara |
| 4,387,730 | A | 6/1983 | Shioi |
| 4,399,826 | A | 8/1983 | Ogasawara |
| D271,444 | S | 11/1983 | LeVine |
| 4,421,127 | A | 12/1983 | Geer |
| 4,446,900 | A | 5/1984 | Markovich |
| 4,465,189 | A | 8/1984 | Molzan |
| 4,569,438 | A | 2/1986 | Sheffler |
| 4,655,342 | A | 4/1987 | Brauner et al. |
| 4,743,038 | A | 5/1988 | Myers et al. |
| 4,799,503 | A | 1/1989 | Tahara |
| 4,818,502 | A | 4/1989 | Taschner |
| 4,840,288 | A | 6/1989 | Lunderman et al. |
| 4,901,882 | A | 2/1990 | Goncalves |
| 4,915,913 | A | 4/1990 | Williams et al. |
| 4,917,131 | A | 4/1990 | Contreras, Sr. |
| 4,938,355 | A | 7/1990 | Rocco |
| D314,666 | S | 2/1991 | Lanius |
| 5,011,013 | A | 4/1991 | Meisner et al. |
| 5,011,020 | A | 4/1991 | Stevens et al. |
| 5,022,516 | A | 6/1991 | Urban et al. |
| 5,050,623 | A | 9/1991 | Yuhara et al. |
| 5,050,740 | A | 9/1991 | Lucero |
| 5,065,885 | A | 11/1991 | Scaroni |
| 5,125,531 | A | 6/1992 | Wentz |
| 5,125,697 | A | 6/1992 | Kahl et al. |
| D328,818 | S | 8/1992 | Hanna et al. |
| 5,145,064 | A | 9/1992 | Chen |
| 5,205,431 | A | 4/1993 | Zinnbauer |
| 5,322,178 | A | 6/1994 | Foos |
| 5,323,924 | A | 6/1994 | Wolff |
| 5,337,913 | A | 8/1994 | Fukuda |
| 5,348,185 | A | 9/1994 | Buckner, III et al. |
| 5,353,946 | A | 10/1994 | Behrend |
| 5,394,966 | A | 3/1995 | Chow |
| 5,407,038 | A | 4/1995 | Pedlar |
| 5,472,110 | A | 12/1995 | Boyd et al. |
| 5,505,328 | A | 4/1996 | Stribiak |
| 5,560,476 | A | 10/1996 | Lee |
| 5,603,558 | A | 2/1997 | Zimmer |
| D379,266 | S | 5/1997 | Dickinson et al. |
| 5,641,065 | A | 6/1997 | Owens et al. |
| 5,641,066 | A | 6/1997 | Mascaro |
| 5,655,553 | A | 8/1997 | Giese et al. |
| 5,655,677 | A | 8/1997 | Fratello et al. |
| 5,682,910 | A | 11/1997 | Kizawa et al. |
| 5,695,087 | A | 12/1997 | Tutton et al. |
| 5,707,757 | A | 1/1998 | Lee |
| 5,709,008 | A | 1/1998 | Dickinson |
| 5,730,310 | A | 3/1998 | Yoshihara |
| 5,769,260 | A | 6/1998 | Killinger et al. |
| 5,787,906 | A | 8/1998 | D'Andrea |
| 5,826,718 | A | 10/1998 | Ahern, Jr. et al. |
| D402,111 | S | 12/1998 | Dickinson et al. |
| D404,916 | S | 2/1999 | Dickinson et al. |
| 5,873,467 | A | 2/1999 | Willhite et al. |
| 5,875,918 | A | 3/1999 | Sheffler et al. |
| 5,882,097 | A | 3/1999 | Kohagen et al. |
| 5,887,715 | A | 3/1999 | Vasudeva |
| 5,887,745 | A | 3/1999 | Wood |
| D418,977 | S | 1/2000 | Streich et al. |
| 6,021,784 | A | 2/2000 | Yuhara |
| 6,021,901 | A | 2/2000 | Wolfe |
| D426,705 | S | 6/2000 | Fang |
| 6,076,679 | A | 6/2000 | Yuhara et al. |
| 6,082,539 | A | 7/2000 | Lee |
| 6,085,928 | A | 7/2000 | Dickinson et al. |
| 6,102,455 | A | 8/2000 | Schurman |
| 6,105,767 | A | 8/2000 | Vasudeva |
| 6,126,011 | A | 10/2000 | Ullmann et al. |
| 6,138,850 | A | 10/2000 | Berry, III |
| 6,186,152 | B1 | 2/2001 | Gueret |
| D439,407 | S | 3/2001 | Parker |
| 6,199,559 | B1 | 3/2001 | Nikolaus et al. |
| 6,202,887 | B1 | 3/2001 | Petit |
| 6,217,835 | B1 | 4/2001 | Riley et al. |
| D441,954 | S | 5/2001 | Parker |
| 6,234,287 | B1 | 5/2001 | Pfeiffer |
| 6,240,930 | B1 | 6/2001 | Yuhara |
| 6,269,969 | B1 | 8/2001 | Huang et al. |
| 6,283,129 | B1 | 9/2001 | Yuhara et al. |
| 6,286,667 | B1 | 9/2001 | Lee |
| 6,336,460 | B2 | 1/2002 | Yuhara |
| D453,624 | S | 2/2002 | Itzkovitch |
| 6,371,326 | B1 | 4/2002 | Gabele et al. |
| 6,385,897 | B1 | 5/2002 | Klabunde |
| 6,386,209 | B1 | 5/2002 | Yuhara et al. |
| D458,840 | S | 6/2002 | Lai |
| D462,519 | S | 9/2002 | Gaydos et al. |
| 6,446,809 | B2 | 9/2002 | Flynn |
| 6,474,097 | B2 | 11/2002 | Treppedi et al. |
| D466,295 | S | 12/2002 | Snider |
| D467,424 | S | 12/2002 | Hardigg et al. |
| D467,425 | S | 12/2002 | Hardigg et al. |
| D467,426 | S | 12/2002 | Hardigg et al. |
| 6,527,309 | B1 | 3/2003 | Gaydos et al. |
| D472,384 | S | 4/2003 | Richardson |
| D474,340 | S | 5/2003 | Vasudeva |
| 6,595,362 | B2 | 7/2003 | Penney et al. |
| D478,209 | S | 8/2003 | Chen |
| D482,529 | S | 11/2003 | Hardigg et al. |
| D485,069 | S | 1/2004 | Parker |
| 6,691,843 | B2 | 2/2004 | Nykoluk et al. |
| D487,192 | S | 3/2004 | Farnham et al. |
| 6,698,608 | B2 | 3/2004 | Parker et al. |
| 6,722,496 | B2 | 4/2004 | Gantert |
| D489,530 | S | 5/2004 | Lindsay |
| D492,184 | S | 6/2004 | Parker et al. |
| 6,752,092 | B2 | 6/2004 | Beattie et al. |
| 6,779,681 | B2 | 8/2004 | Doerfler et al. |
| 6,789,692 | B2 | 9/2004 | Prezelin |
| 6,793,096 | B1 | 9/2004 | Seok |
| D499,549 | S | 12/2004 | Rosler |
| 6,832,686 | B2 | 12/2004 | Donegan |
| 6,880,698 | B2 | 4/2005 | Fiore, Jr. et al. |
| 6,889,838 | B2 | 5/2005 | Meier et al. |
| D507,701 | S | 7/2005 | Chen |
| 6,913,143 | B2 | 7/2005 | Yang |
| D507,877 | S | 8/2005 | Lin |
| 6,955,381 | B2 | 10/2005 | Parker et al. |
| 6,962,263 | B2 | 11/2005 | Cadiente et al. |
| D512,221 | S | 12/2005 | Allan et al. |
| D513,122 | S | 12/2005 | Greene |
| D513,123 | S | 12/2005 | Richardson et al. |
| D514,808 | S | 2/2006 | Morine et al. |
| 6,997,315 | B2 | 2/2006 | Myer et al. |
| D516,309 | S | 3/2006 | Richardson et al. |
| D516,807 | S | 3/2006 | Richardson et al. |
| 7,017,776 | B1 | 3/2006 | Hupp |

(56) References Cited

U.S. PATENT DOCUMENTS

| | | | |
|---|---|---|---|
| D523,242 | S | 6/2006 | Hardigg et al. |
| D523,244 | S | 6/2006 | Peterson |
| D524,541 | S | 7/2006 | Cauley |
| D527,182 | S | 8/2006 | Ham |
| D527,523 | S | 9/2006 | Cornwell et al. |
| D528,793 | S | 9/2006 | Cornwell et al. |
| RE39,311 | E | 10/2006 | Davis et al. |
| D530,514 | S | 10/2006 | Hernandez et al. |
| D543,700 | S | 6/2007 | Parker et al. |
| D548,971 | S | 8/2007 | Lin |
| 7,258,230 | B2 | 8/2007 | Hernandez, Jr. et al. |
| D552,352 | S | 10/2007 | Lin |
| D553,857 | S | 10/2007 | Pendergraph et al. |
| D555,357 | S | 11/2007 | Hsieh |
| D555,902 | S | 11/2007 | Pendergraph et al. |
| D557,897 | S | 12/2007 | Richardson et al. |
| 7,314,052 | B2 | 1/2008 | Yuhara et al. |
| D563,102 | S | 3/2008 | Cornwell et al. |
| D563,670 | S | 3/2008 | Cornwell et al. |
| D563,672 | S | 3/2008 | Cornwell et al. |
| 7,347,325 | B2 | 3/2008 | O'Neill et al. |
| D565,299 | S | 4/2008 | Schneider |
| 7,357,250 | B2 | 4/2008 | Hagemann et al. |
| D569,616 | S | 5/2008 | Lin |
| 7,367,449 | B2 | 5/2008 | Kaminski et al. |
| 7,367,451 | B2 | 5/2008 | Pendergraph et al. |
| 7,370,891 | B1 | 5/2008 | Schmitt et al. |
| D572,480 | S | 7/2008 | Buck et al. |
| 7,401,698 | B2 | 7/2008 | Dost et al. |
| D579,201 | S | 10/2008 | Galli |
| D579,202 | S | 10/2008 | Grenier et al. |
| 7,438,198 | B2 | 10/2008 | Pickles |
| D580,655 | S | 11/2008 | Kao |
| 7,497,328 | B2 | 3/2009 | Tonelli |
| 7,540,364 | B2 | 6/2009 | Sanderson |
| D595,958 | S | 7/2009 | Twig |
| 7,573,385 | B2 | 8/2009 | Tonelli |
| D599,112 | S | 9/2009 | Wenchel et al. |
| D600,015 | S | 9/2009 | Wenchel et al. |
| 7,597,199 | B1 | 10/2009 | Rochelo |
| 7,600,640 | B2 | 10/2009 | Hallee et al. |
| D605,853 | S | 12/2009 | Horiyama et al. |
| D606,308 | S | 12/2009 | Cheng-Wei |
| 7,628,113 | B2 | 12/2009 | Pallo et al. |
| D607,207 | S | 1/2010 | Horiyama et al. |
| D608,094 | S | 1/2010 | Concari et al. |
| D612,152 | S | 3/2010 | Roesler |
| D616,200 | S | 5/2010 | Riedel et al. |
| D617,556 | S | 6/2010 | Molina et al. |
| D617,557 | S | 6/2010 | Molina et al. |
| D617,987 | S | 6/2010 | Wang |
| D620,255 | S | 7/2010 | Chang |
| 7,748,158 | B2 | 7/2010 | Wieringa et al. |
| D624,317 | S | 9/2010 | Wenchel et al. |
| 7,806,290 | B2 | 10/2010 | Timm et al. |
| D630,435 | S | 1/2011 | Brunner |
| D630,849 | S | 1/2011 | Toner |
| 7,870,862 | B2 | 1/2011 | Yuhara et al. |
| D636,182 | S | 4/2011 | Yang |
| D636,996 | S | 5/2011 | Kokawa et al. |
| D638,217 | S | 5/2011 | von Gottberg et al. |
| D639,058 | S | 6/2011 | Chiu |
| D645,663 | S | 9/2011 | Henley et al. |
| D647,300 | S | 10/2011 | Shitrit et al. |
| D648,531 | S | 11/2011 | Finnigan et al. |
| 8,061,492 | B2 | 11/2011 | Riedel et al. |
| D650,173 | S | 12/2011 | Lima et al. |
| 8,079,467 | B2 | 12/2011 | Barette et al. |
| D659,396 | S | 5/2012 | Hsu |
| D664,356 | S | 7/2012 | Liao |
| 8,210,579 | B2 | 7/2012 | Vilkomirski |
| 8,245,868 | B2 | 8/2012 | Keda et al. |
| D666,811 | S | 9/2012 | Yang |
| D668,455 | S | 10/2012 | Chang |
| D668,866 | S | 10/2012 | Meng |
| D668,873 | S | 10/2012 | Robinson et al. |
| D668,874 | S | 10/2012 | Robinson et al. |
| 8,297,464 | B2 | 10/2012 | Grenier et al. |
| D672,555 | S | 12/2012 | Shitrit |
| 8,327,576 | B2 | 12/2012 | Sellers |
| D674,605 | S | 1/2013 | Vilkomirski et al. |
| D676,239 | S | 2/2013 | Benoit et al. |
| 8,511,499 | B2 | 8/2013 | Perry et al. |
| 8,540,948 | B2 | 9/2013 | Loehn |
| D691,801 | S | 10/2013 | Lin |
| 8,567,631 | B2 | 10/2013 | Brunner |
| 8,567,828 | B2 | 10/2013 | Andren et al. |
| 8,590,724 | B2 | 11/2013 | Kreidler et al. |
| D694,521 | S | 12/2013 | Robinson et al. |
| 8,623,289 | B2 | 1/2014 | Cesa et al. |
| 8,627,981 | B2 | 1/2014 | Perry et al. |
| 8,678,217 | B2 | 3/2014 | Green |
| D703,437 | S | 4/2014 | Bar-Erez |
| D704,442 | S | 5/2014 | Chen |
| 8,714,355 | B2 | 5/2014 | Huang |
| D709,286 | S | 7/2014 | Takayanagi et al. |
| D709,697 | S | 7/2014 | Brunner |
| D709,698 | S | 7/2014 | Brunner |
| 8,770,426 | B2 | 7/2014 | Arnett et al. |
| 8,789,699 | B2 | 7/2014 | Patstone et al. |
| D710,098 | S | 8/2014 | Horowitz |
| D710,100 | S | 8/2014 | Brunner |
| D710,104 | S | 8/2014 | Tivoly |
| D711,105 | S | 8/2014 | Brunner |
| 8,800,795 | B2 | 8/2014 | Hwang |
| D712,137 | S | 9/2014 | Hsu |
| D719,352 | S | 12/2014 | Shitrit |
| 8,910,788 | B2 | 12/2014 | Roach et al. |
| 8,915,361 | B2 | 12/2014 | Rayner |
| D721,231 | S | 1/2015 | Steele |
| D721,491 | S | 1/2015 | Wang |
| D721,891 | S | 2/2015 | Ben-Gigi |
| 8,960,430 | B2 | 2/2015 | Roach et al. |
| 8,985,385 | B2 | 3/2015 | Parker et al. |
| D727,254 | S | 4/2015 | Kinoshita et al. |
| D727,622 | S | 4/2015 | Hile |
| 8,998,014 | B2 | 4/2015 | Iwasaki |
| 9,010,570 | B2 | 4/2015 | Gelardi et al. |
| 9,067,081 | B2 | 6/2015 | Roach et al. |
| D733,429 | S | 7/2015 | Grenier et al. |
| D734,761 | S | 7/2015 | Ballou et al. |
| 9,072,653 | B2 | 7/2015 | Nemard |
| 9,085,403 | B2 | 7/2015 | Roach et al. |
| D735,995 | S | 8/2015 | Lin |
| 9,114,909 | B2 | 8/2015 | Wagner |
| D738,106 | S | 9/2015 | Shitrit |
| D740,559 | S | 10/2015 | Steele et al. |
| D742,640 | S | 11/2015 | Sabbag et al. |
| D743,169 | S | 11/2015 | Therkom |
| 9,193,060 | B2 | 11/2015 | Ben-Gigi |
| 9,226,986 | B2 | 1/2016 | Gray-Dreizler et al. |
| 9,229,494 | B2 | 1/2016 | Rayner |
| 9,238,301 | B2 | 1/2016 | Streich et al. |
| D749,845 | S | 2/2016 | Tonelli |
| D750,890 | S | 3/2016 | Quehl |
| D753,394 | S | 4/2016 | Brunner |
| D753,917 | S | 4/2016 | Koeniger |
| D754,436 | S | 4/2016 | Ou |
| D754,439 | S | 4/2016 | Ou |
| D757,435 | S | 5/2016 | Damberg |
| D759,971 | S | 6/2016 | Riddiford et al. |
| 9,375,835 | B1 | 6/2016 | Lin |
| 9,383,788 | B2 | 7/2016 | Reber et al. |
| 9,393,077 | B2 | 7/2016 | Schuster |
| 9,393,684 | B2 | 7/2016 | Christopher et al. |
| 9,399,263 | B2 | 7/2016 | Bashore et al. |
| 9,414,701 | B1 | 8/2016 | Yen et al. |
| 9,428,312 | B2 | 8/2016 | Manahan |
| 9,451,816 | B2 | 9/2016 | Hynecek et al. |
| 9,469,024 | B2 | 10/2016 | Bensman et al. |
| D773,184 | S | 12/2016 | Ko |
| D773,817 | S | 12/2016 | Hower |
| D774,757 | S | 12/2016 | Bournay, Jr. et al. |
| 9,527,638 | B2 | 12/2016 | Yoo et al. |

(56) References Cited

U.S. PATENT DOCUMENTS

D776,523 S 1/2017 Sabbag et al.
9,559,739 B2 1/2017 Murphy et al.
D778,610 S 2/2017 Chen
D779,822 S 2/2017 Grenier et al.
D784,629 S 4/2017 Farrish
D785,938 S 5/2017 Ou
9,637,281 B2 5/2017 Koo
D789,086 S 6/2017 Lin
D789,087 S 6/2017 Harrah
D792,094 S 7/2017 Stoikos et al.
D792,708 S 7/2017 Tazawa et al.
D793,074 S 8/2017 Tollefsbol et al.
D795,579 S 8/2017 Sarfati et al.
9,725,209 B1 8/2017 Ben-Gigi
D798,053 S 9/2017 Shitrit
D798,054 S 9/2017 Shpitzer et al.
9,764,878 B2 9/2017 Semer
D799,822 S 10/2017 Kanda et al.
9,796,523 B2 10/2017 Benoit et al.
9,797,680 B2 10/2017 Hyde et al.
D801,684 S 11/2017 Chang
D803,561 S 11/2017 Kuhls
D805,775 S 12/2017 Tsai
9,850,029 B2 12/2017 Brunner
D808,653 S 1/2018 Rayeski et al.
9,883,665 B2 2/2018 Heaton
9,888,977 B2 2/2018 Thomas et al.
D814,187 S 4/2018 Caglar
9,943,152 B2 4/2018 Law et al.
D818,619 S 5/2018 Hanwell
D819,331 S 6/2018 Ballou et al.
D823,788 S 7/2018 Wei
10,012,632 B2 7/2018 Tomellini et al.
10,022,856 B2 7/2018 Bensman et al.
10,034,532 B2 7/2018 Zhan
D825,465 S 8/2018 Deng
10,058,480 B2 8/2018 Janson et al.
D828,028 S 9/2018 Seiders et al.
D828,029 S 9/2018 Seiders et al.
D829,213 S 9/2018 Szeremeta et al.
10,065,304 B2 9/2018 Bensman et al.
D830,765 S 10/2018 Croft et al.
D831,445 S 10/2018 Karger et al.
D833,211 S 11/2018 Croft et al.
10,131,485 B2 11/2018 Soules et al.
D834,819 S 12/2018 Burek et al.
10,161,165 B2 12/2018 Yuan
D838,983 S 1/2019 Seiders et al.
D838,984 S 1/2019 Seiders et al.
10,173,826 B2 1/2019 Sexton et al.
10,179,681 B2 1/2019 Timm et al.
D840,150 S 2/2019 Seiders et al.
10,194,725 B2 2/2019 Lai et al.
10,201,250 B2 2/2019 Van Puijenbroek et al.
10,236,711 B1 3/2019 Miller
D844,985 S 4/2019 Shelffo
10,244,840 B2 4/2019 Zhu et al.
10,314,377 B2 6/2019 Stephens
D852,506 S 7/2019 Clayton
10,340,970 B2 7/2019 Richardson et al.
10,349,723 B2 7/2019 Kim
D857,389 S 8/2019 Hsiao
10,384,842 B2 8/2019 Kim
10,384,843 B2 8/2019 Vovan et al.
10,392,175 B2 8/2019 Kinskey
10,401,075 B2 9/2019 Bond
10,405,626 B2 9/2019 Gonitianer et al.
10,427,841 B2 10/2019 Weisshaupt et al.
10,434,206 B2 10/2019 Thomas et al.
10,450,104 B2 10/2019 Han
D866,967 S 11/2019 Meng
10,484,035 B2 11/2019 Flores et al.
D869,160 S 12/2019 Seiders et al.
10,500,711 B2 12/2019 Steele et al.
D872,478 S 1/2020 Seiders et al.
D872,485 S 1/2020 Seiders et al.
D873,020 S 1/2020 Seiders et al.
10,539,317 B2 1/2020 Werner et al.
D874,146 S 2/2020 Rogers et al.
D874,147 S 2/2020 Rogers et al.
D874,148 S 2/2020 Rogers et al.
10,561,133 B2 2/2020 Martin
10,569,412 B1 2/2020 Reyes
D876,821 S 3/2020 Lee
10,583,969 B2 3/2020 Perry et al.
D880,859 S 4/2020 Lourenco
D881,812 S 4/2020 Yang
D882,262 S 4/2020 Zhang
D882,390 S 4/2020 Sun et al.
10,624,430 B1 4/2020 Godwin, III et al.
10,625,910 B2 4/2020 Hu et al.
D882,952 S 5/2020 Austin et al.
D887,137 S 6/2020 Burek et al.
D890,522 S 7/2020 Stanley
10,722,012 B2 7/2020 Kraus et al.
D891,769 S 8/2020 Chen
D893,876 S 8/2020 Van Fossen
10,730,665 B2 8/2020 Liu
10,737,869 B2 8/2020 Graf et al.
10,750,833 B2 8/2020 Burchia
D896,179 S 9/2020 Yang
D896,518 S 9/2020 Brunner et al.
D897,103 S 9/2020 Brunner et al.
10,808,745 B1 10/2020 Javali et al.
D904,829 S 12/2020 Nichols et al.
D911,020 S 2/2021 Lee
10,954,055 B2 3/2021 Rogers et al.
11,192,235 B2 12/2021 Steele et al.
11,242,189 B2 2/2022 Rogers et al.
11,318,599 B2 5/2022 Samsel et al.
11,369,174 B2 6/2022 Martin
11,426,858 B2 8/2022 Jiang
11,465,807 B2 10/2022 Morisey
11,554,901 B2 1/2023 Lesizza et al.
11,565,848 B2 1/2023 Taylor et al.
11,583,047 B2 2/2023 Kim
11,634,270 B2 4/2023 Whalen et al.
D985,937 S 5/2023 Bullock et al.
11,685,573 B2 6/2023 Nichols et al.
11,702,257 B2 7/2023 Burek et al.
11,717,954 B2 8/2023 Heath et al.
11,738,914 B2 8/2023 Bullock et al.
11,793,284 B2 10/2023 Edlund Tjernberg et al.
11,884,456 B2 1/2024 Whitmire et al.
11,884,457 B2 1/2024 Whalen et al.
11,889,949 B2 2/2024 Casey et al.
2002/0047011 A1 4/2002 Lee
2002/0179473 A1 12/2002 Chao
2002/0185404 A1 12/2002 Donegan
2003/0015534 A1 1/2003 Lown et al.
2003/0038142 A1 2/2003 Gee
2003/0106821 A1 6/2003 Bar-Erez
2003/0111476 A1 6/2003 Serio
2004/0112777 A1 6/2004 Huang
2004/0187256 A1 9/2004 Lee
2005/0035125 A1 2/2005 Bae
2005/0045505 A1 3/2005 Vandevenne et al.
2005/0045628 A1 3/2005 Chan
2006/0017293 A1 1/2006 Tonelli
2006/0026795 A1 2/2006 Tonelli
2006/0118565 A1 6/2006 Higer
2006/0144077 A1 7/2006 Morris
2006/0144729 A1 7/2006 Cheung
2006/0186003 A1 8/2006 Dost et al.
2006/0201833 A1 9/2006 Chen
2007/0034637 A1 2/2007 Carmichael
2007/0074984 A1 4/2007 Liu
2007/0164020 A1* 7/2007 Arnett ..... A45C 5/02 220/4.21
2007/0232109 A1 10/2007 Parker et al.
2008/0215440 A1 9/2008 Peterson et al.
2008/0308568 A1 12/2008 Grenier et al.
2009/0038901 A1 2/2009 Pomerantz
2009/0114646 A1 5/2009 Whalen

(56) References Cited

U.S. PATENT DOCUMENTS

| | | | | |
|---|---|---|---|---|
| 2009/0199941 | A1 | 8/2009 | Toner et al. | |
| 2009/0255842 | A1 | 10/2009 | Brozell et al. | |
| 2010/0012538 | A1 | 1/2010 | Brunner | |
| 2010/0200581 | A1* | 8/2010 | Maltz | B65D 43/165 220/326 |
| 2010/0263399 | A1 | 10/2010 | Pollina et al. | |
| 2011/0147386 | A1 | 6/2011 | Whalen | |
| 2012/0152944 | A1 | 6/2012 | Vilkomirski et al. | |
| 2012/0168444 | A1 | 7/2012 | Shitrit et al. | |
| 2012/0261042 | A1 | 10/2012 | Khubani | |
| 2013/0081364 | A1 | 4/2013 | Piscopo | |
| 2013/0127183 | A1 | 5/2013 | Chang | |
| 2013/0175276 | A1 | 7/2013 | Gleichauf et al. | |
| 2013/0186795 | A1 | 7/2013 | Borrelli | |
| 2014/0231307 | A1 | 8/2014 | Wen | |
| 2016/0045054 | A1 | 2/2016 | Su | |
| 2016/0084454 | A1 | 3/2016 | Svitak, Sr. et al. | |
| 2016/0183651 | A1 | 6/2016 | Tonelli | |
| 2016/0338458 | A1 | 11/2016 | Negrini | |
| 2017/0101229 | A1 | 4/2017 | Perek | |
| 2017/0173781 | A1 | 6/2017 | Damberg | |
| 2017/0197765 | A1 | 7/2017 | Hu et al. | |
| 2017/0247151 | A1 | 8/2017 | Chiou | |
| 2017/0265448 | A1 | 9/2017 | Duffy | |
| 2017/0318927 | A1 | 11/2017 | Kraus et al. | |
| 2017/0325441 | A1* | 11/2017 | Martin | B65D 25/10 |
| 2018/0070702 | A1 | 3/2018 | Lee et al. | |
| 2018/0244444 | A1 | 8/2018 | Pereira Da Silva | |
| 2018/0265263 | A1 | 9/2018 | Li | |
| 2018/0354687 | A1 | 12/2018 | Seiders et al. | |
| 2019/0054985 | A1 | 2/2019 | Bladd-Symms et al. | |
| 2019/0062018 | A1 | 2/2019 | McClellan | |
| 2019/0075772 | A1 | 3/2019 | Kaihara et al. | |
| 2019/0329398 | A1 | 10/2019 | Karlsson et al. | |
| 2019/0335946 | A1 | 11/2019 | Backaert et al. | |
| 2019/0344951 | A1 | 11/2019 | Rogers et al. | |
| 2020/0003474 | A1 | 1/2020 | Jennie | |
| 2020/0010259 | A1 | 1/2020 | Ganahl | |
| 2020/0029664 | A1 | 1/2020 | Tonelli | |
| 2020/0039056 | A1 | 2/2020 | Damberg | |
| 2020/0045950 | A1 | 2/2020 | Aston et al. | |
| 2020/0189812 | A1 | 6/2020 | Hice et al. | |
| 2020/0216224 | A1 | 7/2020 | Nichols et al. | |
| 2020/0275751 | A1 | 9/2020 | Jirak | |
| 2020/0277104 | A1 | 9/2020 | Taylor et al. | |
| 2020/0298392 | A1 | 9/2020 | Baruch et al. | |
| 2021/0061525 | A1 | 3/2021 | Chapman et al. | |
| 2021/0078159 | A1 | 3/2021 | Jiang | |
| 2022/0110424 | A1 | 4/2022 | Rodgers et al. | |
| 2022/0135294 | A1 | 5/2022 | Peng et al. | |
| 2022/0411147 | A1 | 12/2022 | Murphy | |
| 2023/0092514 | A1 | 3/2023 | Brocket et al. | |
| 2023/0150753 | A1 | 5/2023 | Clayton | |
| 2023/0182974 | A1 | 6/2023 | Jondal et al. | |
| 2023/0255187 | A1 | 8/2023 | Brown et al. | |
| 2023/0278750 | A1 | 9/2023 | Halkowicz et al. | |
| 2023/0380559 | A1 | 11/2023 | Castillo | |
| 2024/0002110 | A1 | 1/2024 | Huang et al. | |

FOREIGN PATENT DOCUMENTS

| | | | |
|---|---|---|---|
| CA | 3026530 | A1 | 6/2020 |
| CN | 2036364 | U | 4/1989 |
| CN | 2312114 | Y | 3/1999 |
| CN | 2372102 | Y | 4/2000 |
| CN | 3317937 | | 9/2003 |
| CN | 2887542 | Y | 4/2007 |
| CN | 2921223 | Y | 7/2007 |
| CN | B669731 | | 7/2007 |
| CN | 101176692 | A | 5/2008 |
| CN | 201119510 | Y | 9/2008 |
| CN | 300848562 | | 11/2008 |
| CN | 201175905 | Y | 1/2009 |
| CN | 201201084 | Y | 3/2009 |
| CN | 201272187 | Y | 7/2009 |
| CN | 301064159 | | 11/2009 |
| CN | 201529983 | U | 7/2010 |
| CN | 201533632 | U | 7/2010 |
| CN | 202547259 | U | 11/2012 |
| CN | 202572374 | U | 12/2012 |
| CN | 202664051 | U | 1/2013 |
| CN | 202698080 | U | 1/2013 |
| CN | 202895187 | U | 4/2013 |
| CN | 302418682 | | 5/2013 |
| CN | 203765600 | U | 8/2014 |
| CN | 302927450 | | 9/2014 |
| CN | 203919011 | U | 11/2014 |
| CN | 204076228 | U | 1/2015 |
| CN | 102599709 | B | 8/2015 |
| CN | 204561221 | U | 8/2015 |
| CN | 204617328 | U | 9/2015 |
| CN | 303362272 | | 9/2015 |
| CN | 204726903 | U | 10/2015 |
| CN | 303418631 | | 10/2015 |
| CN | 303536501 | | 1/2016 |
| CN | 205006180 | U | 2/2016 |
| CN | 303624779 | | 3/2016 |
| CN | 205254956 | U | 5/2016 |
| CN | 303673420 | | 5/2016 |
| CN | 303866212 | | 9/2016 |
| CN | 205633616 | U | 10/2016 |
| CN | 206050440 | U | 3/2017 |
| CN | 106584396 | A | 4/2017 |
| CN | 304125546 | | 5/2017 |
| CN | 206443353 | U | 8/2017 |
| CN | 206534243 | U | 10/2017 |
| CN | 107343697 | A | 11/2017 |
| CN | 207107442 | U | 3/2018 |
| CN | 207172025 | U | 4/2018 |
| CN | 207202346 | U | 4/2018 |
| CN | 207322886 | U | 5/2018 |
| CN | 207341812 | U | 5/2018 |
| CN | 304601524 | | 5/2018 |
| CN | 304719838 | | 7/2018 |
| CN | 304749438 | | 7/2018 |
| CN | 108433289 | A | 8/2018 |
| CN | 207744815 | U | 8/2018 |
| CN | 208002288 | U | 10/2018 |
| CN | 208007722 | U | 10/2018 |
| CN | 208096276 | U | 11/2018 |
| CN | 108942847 | A | 12/2018 |
| CN | 304930143 | | 12/2018 |
| CN | 208339607 | U | 1/2019 |
| CN | 109431035 | A | 3/2019 |
| CN | 208773531 | U | 4/2019 |
| CN | 208773532 | U | 4/2019 |
| CN | 208812053 | U | 5/2019 |
| CN | 208841360 | U | 5/2019 |
| CN | 109834682 | A | 6/2019 |
| CN | 209331280 | U | 9/2019 |
| CN | 209421196 | U | 9/2019 |
| CN | 209441944 | U | 9/2019 |
| CN | 209464096 | U | 10/2019 |
| CN | 209478152 | U | 10/2019 |
| CN | 209551684 | U | 10/2019 |
| CN | 209599175 | U | 11/2019 |
| CN | 305443340 | | 11/2019 |
| CN | 305443343 | | 11/2019 |
| CN | 209825490 | U | 12/2019 |
| CN | 209950573 | U | 1/2020 |
| CN | 305605583 | | 2/2020 |
| CN | 305605584 | | 2/2020 |
| CN | 110916319 | A | 3/2020 |
| CN | 210203700 | U | 3/2020 |
| CN | 210203701 | U | 3/2020 |
| CN | 110946387 | A | 4/2020 |
| CN | 210276264 | U | 4/2020 |
| CN | 210276265 | U | 4/2020 |
| CN | 210299905 | U | 4/2020 |
| CN | 210329687 | U | 4/2020 |
| CN | 305674811 | | 4/2020 |
| CN | 305693439 | | 4/2020 |
| CN | 210445987 | U | 5/2020 |

(56) References Cited

FOREIGN PATENT DOCUMENTS

| | | | |
|---|---|---|---|
| CN | 210471291 | U | 5/2020 |
| CN | 210471292 | U | 5/2020 |
| CN | 210539461 | U | 5/2020 |
| CN | 210611319 | U | 5/2020 |
| CN | 111227472 | A | 6/2020 |
| CN | 111227473 | A | 6/2020 |
| CN | 111283640 | A | 6/2020 |
| CN | 111283641 | A | 6/2020 |
| CN | 111345698 | A | 6/2020 |
| CN | 210747751 | U | 6/2020 |
| CN | 210809640 | U | 6/2020 |
| CN | 210870222 | U | 6/2020 |
| CN | 305863786 | | 6/2020 |
| CN | 305881828 | | 6/2020 |
| CN | 109315903 | B | 7/2020 |
| CN | 111462585 | A | 7/2020 |
| CN | 210960738 | U | 7/2020 |
| CN | 210960739 | U | 7/2020 |
| CN | 210988676 | U | 7/2020 |
| CN | 211021331 | U | 7/2020 |
| CN | 211048615 | U | 7/2020 |
| CN | 211048616 | U | 7/2020 |
| CN | 305942202 | | 7/2020 |
| CN | 211154199 | U | 8/2020 |
| CN | 305960266 | | 8/2020 |
| CN | 305985304 | | 8/2020 |
| CN | 305992582 | | 8/2020 |
| CN | 306000323 | | 8/2020 |
| CN | 111616480 | A | 9/2020 |
| CN | 211379958 | U | 9/2020 |
| CN | 211379959 | U | 9/2020 |
| CN | 211388720 | U | 9/2020 |
| CN | 211407907 | U | 9/2020 |
| CN | 211407909 | U | 9/2020 |
| CN | 211407970 | U | 9/2020 |
| CN | 211431387 | U | 9/2020 |
| CN | 211431388 | U | 9/2020 |
| CN | 211491454 | U | 9/2020 |
| CN | 211533043 | U | 9/2020 |
| CN | 306022339 | | 9/2020 |
| CN | 306056308 | | 9/2020 |
| CN | 211729112 | U | 10/2020 |
| CN | 211761429 | U | 10/2020 |
| CN | 306082237 | | 10/2020 |
| CN | 306082328 | | 10/2020 |
| CN | 211916782 | U | 11/2020 |
| CN | 212146354 | U | 12/2020 |
| CN | 112172088 | A | 1/2021 |
| CN | 112223234 | A | 1/2021 |
| CN | 306294576 | | 1/2021 |
| CN | 112298814 | A | 2/2021 |
| CN | 212601747 | U | 2/2021 |
| CN | 306317832 | | 2/2021 |
| CN | 306344615 | | 2/2021 |
| CN | 212635691 | U | 3/2021 |
| CN | 212706686 | U | 3/2021 |
| CN | 212706692 | U | 3/2021 |
| DE | 8219905 | U1 | 8/1982 |
| DE | 4433520 | A1 | 3/1996 |
| DE | 29722075 | U1 | 2/1998 |
| DE | 29904675 | U1 | 7/1999 |
| DE | 202004011721 | U1 | 11/2004 |
| DE | 102004063398 | A1 | 7/2005 |
| DE | 202007002159 | U1 | 6/2007 |
| DE | 10210889 | B4 | 11/2007 |
| DE | 102007017834 | A1 | 11/2007 |
| DE | 102007042972 | A1 | 6/2008 |
| DE | 102005024810 | B4 | 3/2009 |
| DE | 202009010021 | U1 | 9/2009 |
| DE | 202009010552 | U1 | 10/2009 |
| DE | 202009003692 | U1 | 11/2009 |
| DE | 10157494 | B4 | 3/2011 |
| DE | 202012002487 | U1 | 5/2012 |
| DE | 202012101277 | U1 | 6/2012 |
| DE | 202012102803 | U1 | 10/2013 |
| DE | 202013010997 | U1 | 1/2014 |
| DE | 202015100103 | U1 | 2/2015 |
| DE | 102014000021 | A1 | 7/2015 |
| DE | 212017000158 | U1 | 2/2019 |
| EM | 000908355-0001 | | 5/2008 |
| EM | 000967245-0001 | | 8/2008 |
| EM | 001398929-0005 | | 1/2014 |
| EM | 002802827-0002 | | 10/2015 |
| EM | 002807552-0001 | | 11/2015 |
| EM | 002831933-0001 | | 7/2016 |
| EM | 003466077-0003 | | 11/2016 |
| EM | 004696979-0001 | | 2/2018 |
| EM | 004696979-0002 | | 2/2018 |
| EM | 004696979-0003 | | 2/2018 |
| EM | 004696979-0004 | | 2/2018 |
| EM | 004696979-0005 | | 2/2018 |
| EM | 005267481-0003 | | 7/2018 |
| EM | 006574406-0001 | | 7/2019 |
| EM | 007295787-0001 | | 12/2019 |
| EM | 007769625-0001 | | 3/2020 |
| EM | 007769625-0002 | | 3/2020 |
| EM | 007769625-0004 | | 3/2020 |
| EM | 007769625-0005 | | 3/2020 |
| EM | 007769625-0006 | | 3/2020 |
| EM | 007769625-0007 | | 3/2020 |
| EM | 007769625-0008 | | 3/2020 |
| EM | 007769625-0009 | | 3/2020 |
| EM | 007771753-0001 | | 6/2020 |
| EM | 007720206-0001 | | 7/2020 |
| EM | 008051395-0002 | | 8/2020 |
| EP | 0658481 | A1 | 6/1995 |
| EP | 0733319 | A1 | 9/1996 |
| EP | 1057098 | A1 | 12/2000 |
| EP | 1080656 | A1 | 3/2001 |
| EP | 1174050 | A2 | 1/2002 |
| EP | 1246762 | A1 | 10/2002 |
| EP | 1339619 | A1 | 9/2003 |
| EP | 1436198 | A2 | 7/2004 |
| EP | 1698247 | A2 | 9/2006 |
| EP | 1700551 | A2 | 9/2006 |
| EP | 1955935 | A2 | 8/2008 |
| EP | 2023765 | A1 | 2/2009 |
| EP | 2756774 | A1 | 7/2014 |
| EP | 2774869 | A1 | 9/2014 |
| EP | 3141354 | B1 | 5/2019 |
| EP | 3113599 | B1 | 3/2020 |
| EP | 3630640 | A4 | 7/2020 |
| EP | 3692874 | A1 | 8/2020 |
| FR | 2566373 | A1 | 12/1985 |
| FR | 2949700 | A3 | 3/2011 |
| GB | 2269368 | B | 10/1994 |
| GB | 2471923 | A | 1/2011 |
| GB | 2472628 | A | 2/2011 |
| GB | 6014054 | | 6/2017 |
| GB | 6104538 | | 10/2020 |
| JP | 4200421 | B2 | 12/2008 |
| JP | 2010285165 | A | 12/2010 |
| JP | D1619392 | | 12/2018 |
| JP | D1625514 | | 2/2019 |
| JP | 2019166586 | A | 10/2019 |
| JP | D1656085 | | 3/2020 |
| JP | 2020054724 | A | 4/2020 |
| JP | 2020070094 | A | 5/2020 |
| JP | D1659982 | | 5/2020 |
| JP | D1659983 | | 5/2020 |
| JP | 6742997 | B2 | 8/2020 |
| JP | D1666655 | | 8/2020 |
| KR | 200206588 | Y1 | 12/2000 |
| KR | 200440773 | Y1 | 7/2008 |
| KR | 300816215.0000 | | 9/2015 |
| KR | 20200000714 | U | 4/2020 |
| KR | 301064642.0000 | | 6/2020 |
| KR | 20200001311 | U | 6/2020 |
| TW | 200823024 | A | 6/2008 |
| TW | 422474 | B | 1/2014 |
| TW | M597591 | U | 7/2020 |
| TW | M598623 | U | 7/2020 |
| WO | D035071-004 | | 2/1996 |
| WO | D037170-001 | | 10/1996 |

(56) References Cited

FOREIGN PATENT DOCUMENTS

| | | | |
|---|---|---|---|
| WO | 2006037302 | A1 | 4/2006 |
| WO | 2009028960 | A1 | 3/2009 |
| WO | 10053952 | A2 | 5/2010 |
| WO | 19135922 | | 1/2013 |
| WO | D081247-002 | | 1/2014 |
| WO | D085824-001 | | 3/2015 |
| WO | D085824-002 | | 3/2015 |
| WO | 16156402 | A1 | 10/2016 |
| WO | 19175723 | | 1/2017 |
| WO | 2019135922 | A1 | 7/2019 |
| WO | 19196652 | | 10/2019 |
| WO | 2020064848 | A1 | 4/2020 |
| WO | 2020120285 | A1 | 6/2020 |
| WO | 2020181241 | A1 | 9/2020 |

OTHER PUBLICATIONS

May 24, 2023—(WO) International Search Report & Written Opinion—PCT/US2022/079726.
Nov. 22, 2024—(JP) First Office Action—App. No. 2024-529354.

* cited by examiner

CONTAINER AND LATCHING SYSTEM

CROSS-REFERENCE TO RELATED APPLICATIONS

This application is a continuation of U.S. patent application Ser. No. 17/530,053, filed Nov. 18, 2021, all of which is herein incorporated by reference in its entirety.

FIELD

This disclosure relates to portable container with latching systems.

BACKGROUND

Various types of containers and latching systems exist. Containers may be used for food, beverages, and other materials or items. Latching systems exist to lock the containers in a closed configuration. However, conventional containers and latching systems are often not very durable and may not be easy to use. For instance, containers may not be strong enough to hold certain items and may not be strong enough to hold items on top of the container. Additionally, some latching systems may engage when a user does not want the system engaged and in other cases may not provide a sufficient lock between for the container. In such arrangements these and other deficiencies may render the container and/or latching system virtually useless.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

One aspect of the disclosure may relate to a container comprising: (a) a base that includes (1) a sidewall structure having at least a first side and a second side opposite the first side, the sidewall structure having a first end and a second end opposite the first end; (2) a bottom portion connected to the first end of the sidewall structure and configured to support the container on a surface; and (3) a base opening formed at the second end of the sidewall structure, where the base opening is configured to allow access to an interior void of the container formed by the sidewall structure and the bottom portion; and (b) a lid pivotally connected to the base and having a shape corresponding to a shape of the base, where the lid is configured to rotate between an open configuration that allows access to the base opening and a closed configuration that prevents access to the base opening; and (c) a latch assembly having a locked position and an unlocked position. The latch assembly may comprise: (a) a latch body pivotally connected to the lid; (b) a latch button slidably connected with the latch body, the latch button having a latch button-locking member; (c) a latch-locking arm pivotally connected to the latch body, where the latch-locking arm has an latch arm-locking member; (d) a latch button biasing member that exerts a linear force on the latch button; and (e) a latch-locking arm biasing member that exerts a rotational force on the latch-locking arm. To move the latch assembly to a locked position, the latch-locking arm engages the base and rotates against the rotational force of the latch-locking arm biasing member, and the latch button moves against the linear force of the latch button biasing member until the latch button-locking member engages the arm-locking member. Additionally, the latch button-locking member may engage the arm-locking member when the latch-locking arm is in a substantially vertical position. In the exemplary embodiment, the latch-locking arm biasing member is a torsional spring. The latch arm-locking member may include a first locking surface and a curved upper surface extending from an upper edge of the first locking surface, where the latch arm-locking member may be substantially centered along the latch-locking arm. The latch-locking arm may have a pair of engaging members arranged on each side of the arm-locking member, and each engaging member of the pair of engaging members may be spaced from the arm-locking member. In addition, each engaging member of the pair of engaging members of the latch-locking arm may have an end with a curved surface that engages a receiver positioned under a lip that extends along the first side of the base. The latch assembly may also include an interlocking pawl that is rotatably attached to the latch body and located closer to an upper edge of the latch body than a lower edge of the latch body. The interlocking pawl may include a central member with an aperture extending through the base, a first protrusion extending outward from the central member, and a second protrusion extending outward from the central member opposite the first protrusion. The first protrusion of the interlocking pawl may contact the latch button when the latch assembly is in the unlocked position to prevent the latch button from moving upwards. And the second protrusion of the interlocking pawl may have a curved outer surface that contacts the lid when the latch assembly is in the unlocked position to prevent the latch assembly from locking before the lid is in the closed configuration. The latch assembly may also include a third biasing member that exerts a second rotational force on the interlocking pawl. In some examples, the container may include a divider that extends across a lid opening of the lid, where the divider is pivotally connected to the lid. The divider may be connected to the lid with a hinge and be selectively secured to the lid on a side opposite the hinge to prevent rotational movement of the divider. The divider may also be releasably secured to the lid with a snap fit. The divider may include a plurality of elongated openings.

Other aspects of the disclosure may relate to a container comprising: (a) a base that includes: (1) a base sidewall structure having at least a first side, a second side opposite the first side, a first end, and a second end, (2) a bottom portion connected to the first end of the base sidewall structure that is configured to support the container on a surface, and (3) a base opening formed at the second end of the base sidewall structure, where the base opening being configured to allow access to a base interior void of the base formed by the base sidewall structure and the bottom portion; and (b) a lid pivotally connected to the base, where the lid includes: (1) a lid sidewall structure that has at least a first side, a second side opposite the first side, a first end, a second end opposite the first end, (2) an upper portion connected to the second end of the lid sidewall structure, (3) a lid opening formed at the first end of the lid sidewall structure the lid opening being configured to allow access to a lid interior void formed by the lid sidewall structure and the upper portion, and (4) a divider pivotally connected to an interior portion of the lid that separates the base interior void and the lid interior void; and (c) a latch assembly pivotally connected to the lid having a locked position and an unlocked position. The divider may include a front side, a rear side, a first side that includes an integrated hinge, and a second side opposite the first side, where the integrated hinge is connected to a hinge receiver of the lid. The lid may be configured to rotate between an open configuration that allows access to the base opening and a closed configuration that prevents access to the base opening. The second side of the divider may include a centrally located recess that forms a pair of tabs, where each tab of the pair of tabs includes an engagement receiver that form a friction fit with a lid engaging member that extends from an interior surface of the lid to prevent rotational movement of the divider. In some examples, the divider may also include a plurality of elongated openings that extend across a portion of the front side of the divider in a direction oriented from the first side of the divider to the second side of the divider. The latch assembly of the container may comprise: (a) a latch body pivotally connected to the lid; (b) a latch button slidably connected with the latch body, where the latch button has a latch button-locking member; (c) a latch-locking arm that is pivotally connected to the latch body, where the latch-locking arm has an arm-locking member; (d) a latch button biasing member that exerts a linear force on the latch button; and (e) a latch-locking arm biasing member that exerts a rotational force on the latch-locking arm. When the latch assembly is moved to the locked position, the latch-locking arm may engage the base and rotate against the rotational force, and the latch button may move against the linear force until the latch button-locking member engages the arm-locking member.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and not limited in the accompanying figures in which like reference numerals indicate similar elements and in which.

Figure 1:
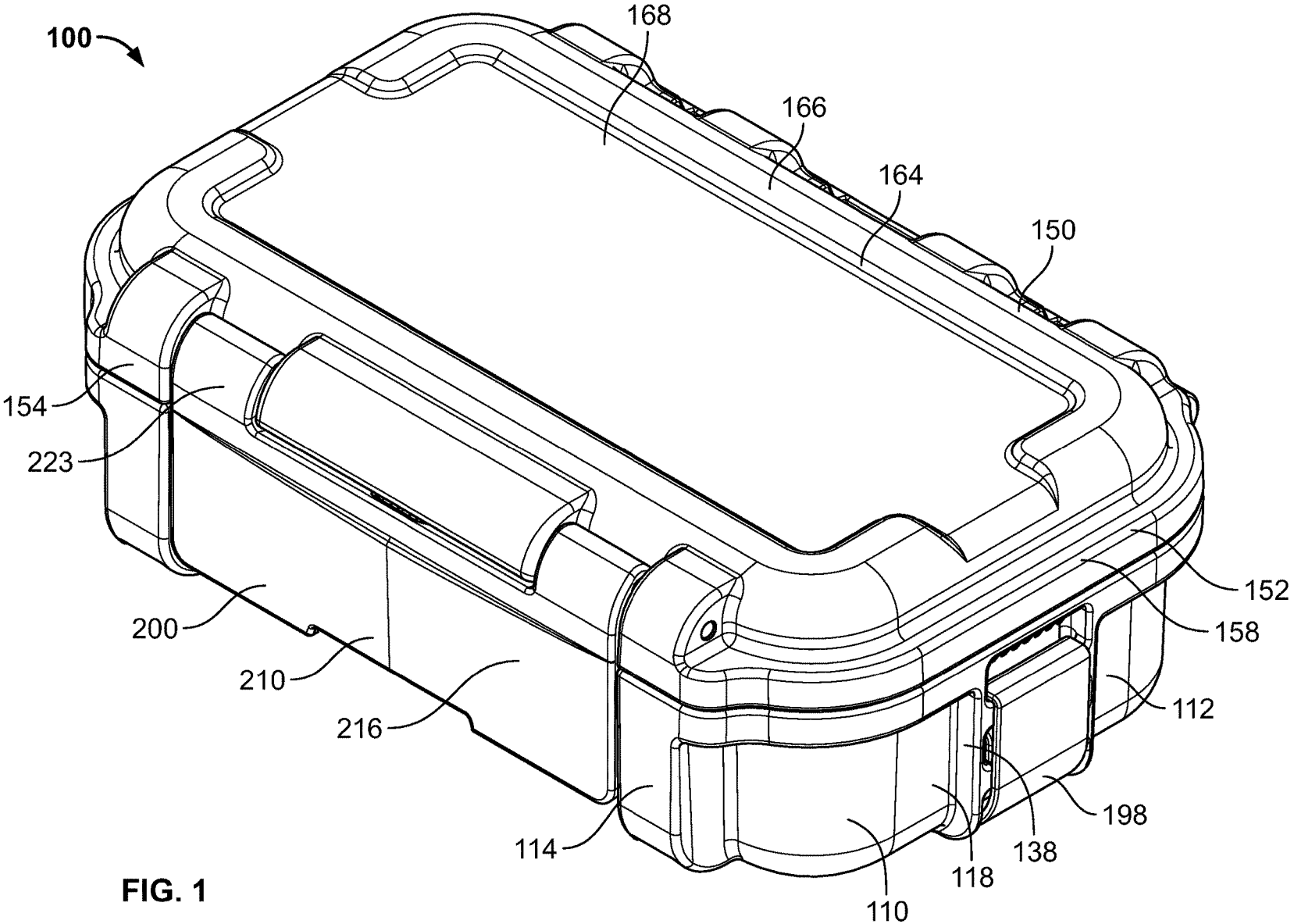
FIG. 1 illustrates a top perspective view of a container in a closed configuration according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

In general, aspects of this invention relate to a containers and latching assemblies for containers. According to various aspects and embodiments, the containers and latching assemblies described herein may be formed of one or more of a variety of materials, such as metals (including metal alloys), polymers, and composites, and may be formed in one of a variety of configurations, without departing from the scope of the invention. It is understood that the containers and latching assemblies may contain components made of several different materials. Additionally, the components may be formed by various forming methods. For example, metal components, may be formed by forging, molding, casting, stamping, machining, and/or other known techniques. Additionally, polymer components, such as elastomers, can be manufactured by polymer processing techniques, such as various molding and casting techniques and/or other known techniques.

The various figures in this application illustrate examples of containers and latching assemblies according to this invention. When the same reference number appears in more than one drawing, that reference number is used consistently in this specification and the drawings refer to the same or similar parts throughout.

FIGS. 1-15 depict different views of a container 100. The container 100 may include a base 110 and a lid 150 that, in some examples, may be coupled, or in some examples may be non-destructively, removably coupled, thereto. The base 110 may be a structure forming a void for containing articles, as will be discussed more fully herein. In some examples, the base 110 may be cuboidal or substantially cuboidal in shape. In other examples, the base 110 may be prismoidal or substantially prismoidal (e.g., a rectangular prism, a pentagonal prism, hexagonal prism, heptagonal prism, or the like) in shape. In still other examples, the base 110 may be substantially cylindrical in shape or may have a substantially trapezoidal cross section. Various other shapes may be used without departing from the invention.

The base 110 may include a base sidewall structure 112 having a first side 114, a second side 116 opposite the first side 114, a third side 118 extending between an edge of the first side 114 and an edge of the second side 116, and a fourth side 120 opposite the third side 118. The base sidewall structure 112 may also include a first end 122 and a second end 124 with a bottom portion 126 connected to the first end 122 of the base sidewall structure 112. The bottom portion 126 may be configured to support the container 100 on a surface such as a table, the ground, or the like. In some embodiments, the bottom portion 126 may also and/or include a support member 128 that may be attached to the bottom portion 126 to help provide a slip resistant surface for the container 100. The support member 128 may be a single member that may be integrally formed with the base 110 or may be attached after the base 110 has been formed. The support member 128 may have a size that encompasses at least 50 percent of the surface area of the bottom portion 126. While not shown, in some examples, the support member 128 may comprise a plurality of feet that are arranged on the bottom portion 126.

Figure 3:
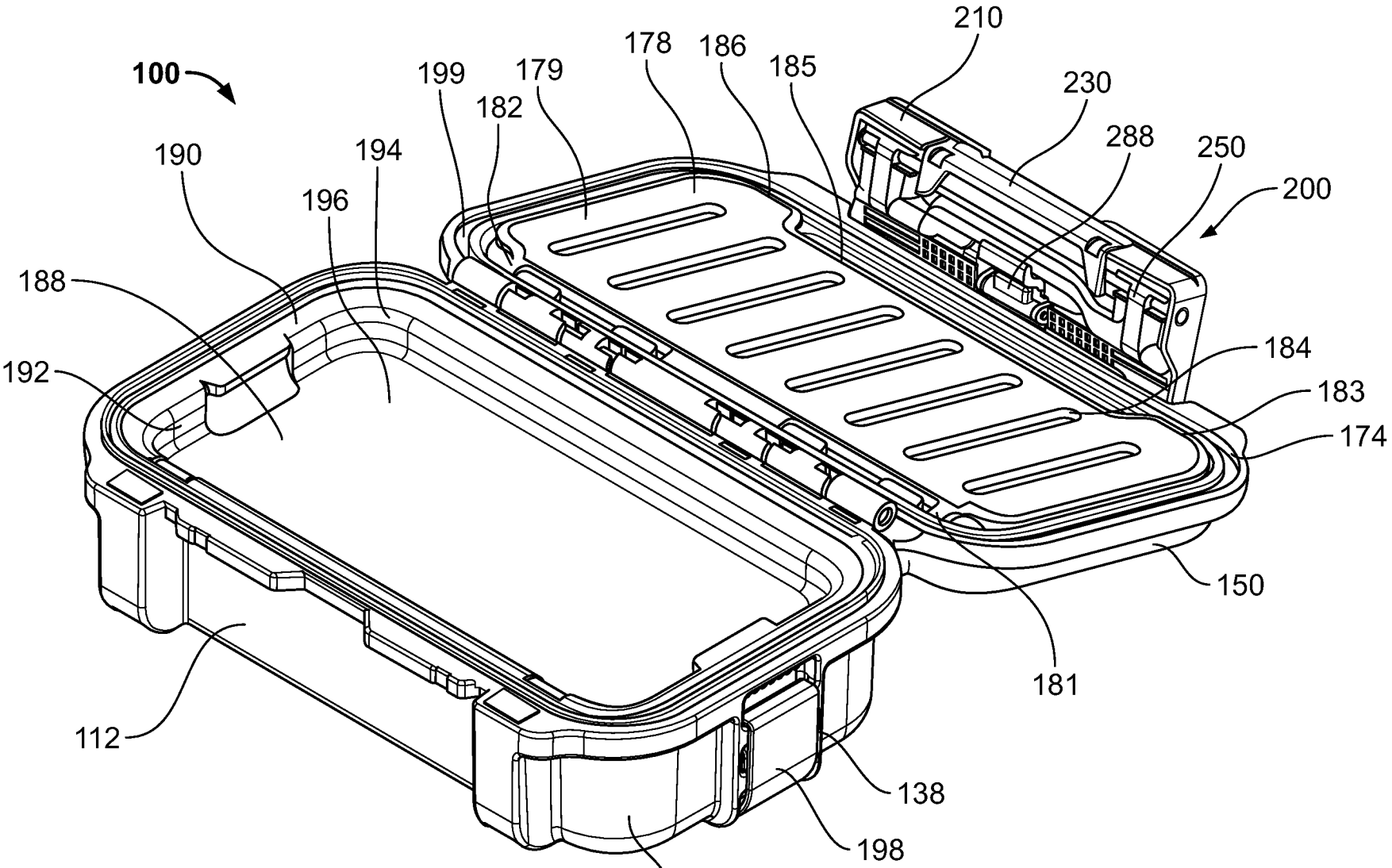
FIG. 3 illustrates a top perspective view of the container of FIG. 1 in an open configuration according to one or more aspects described herein.
Figure 4:
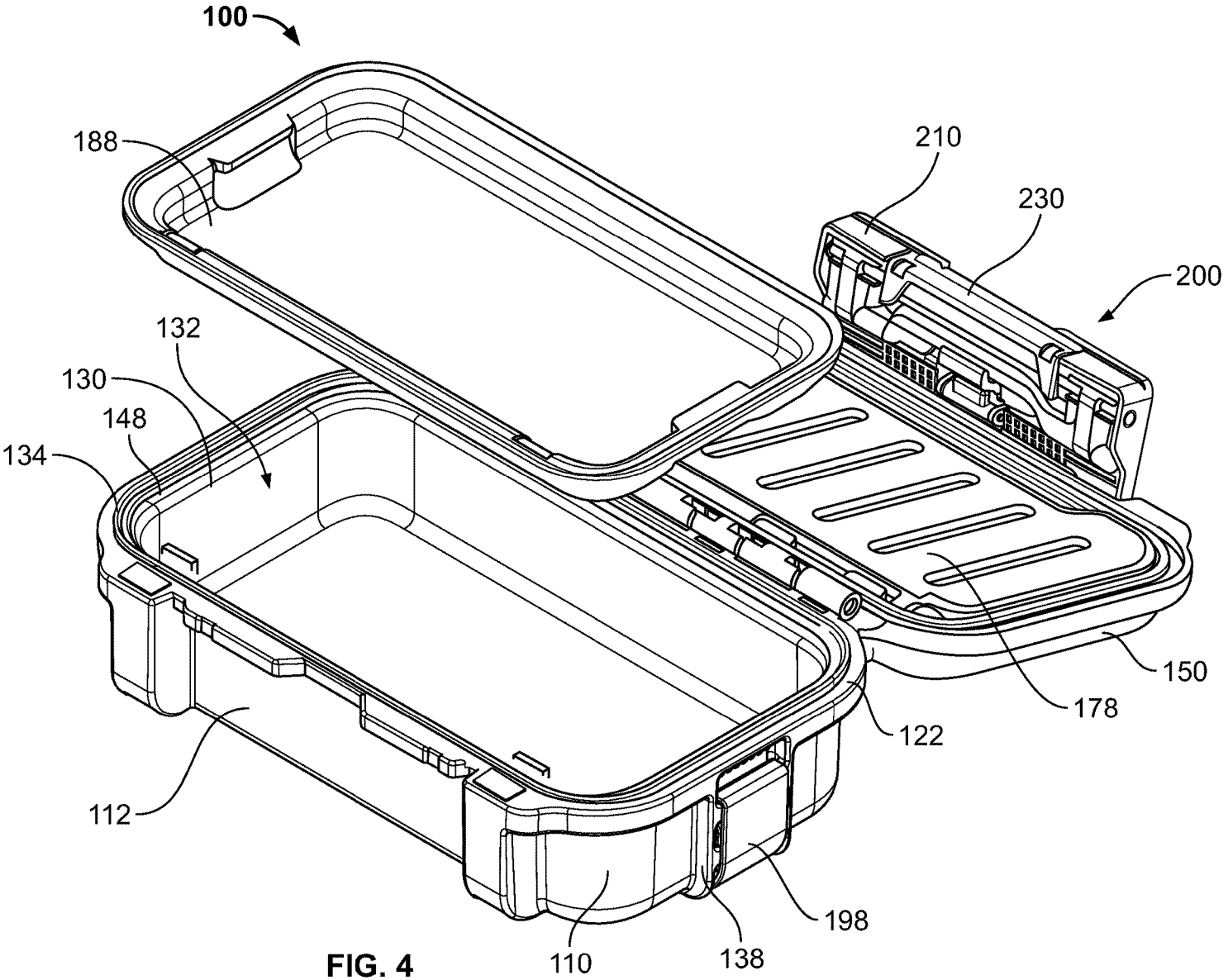
FIG. 4 illustrates an exploded top perspective view of the container of FIG. 1 in an open configuration according to one or more aspects described herein.
Figure 5:
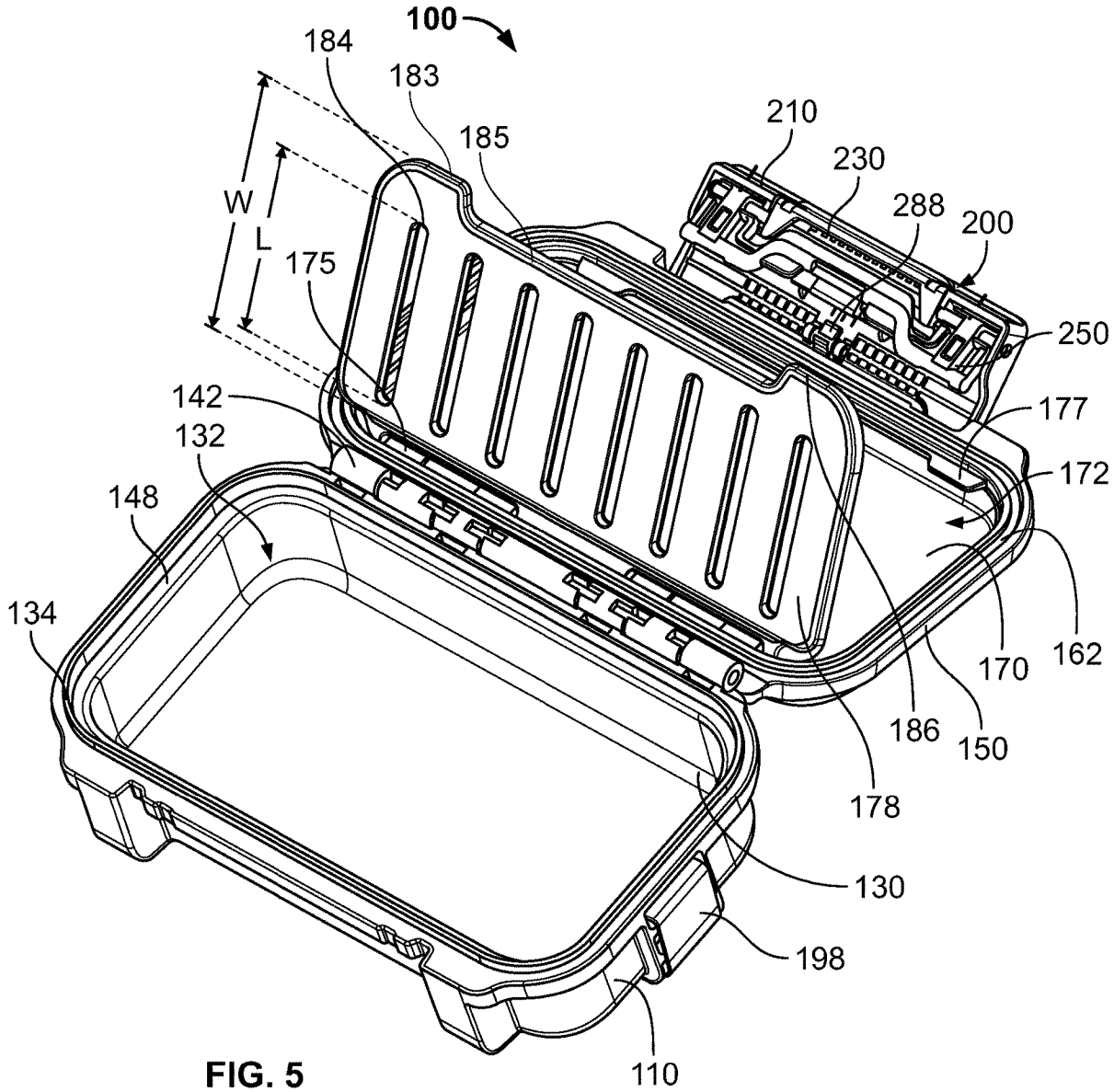
FIG. 5 illustrates a top perspective view of the container of FIG. 1 in an open configuration with some components removed for clarity according to one or more aspects described herein.
Figure 6:
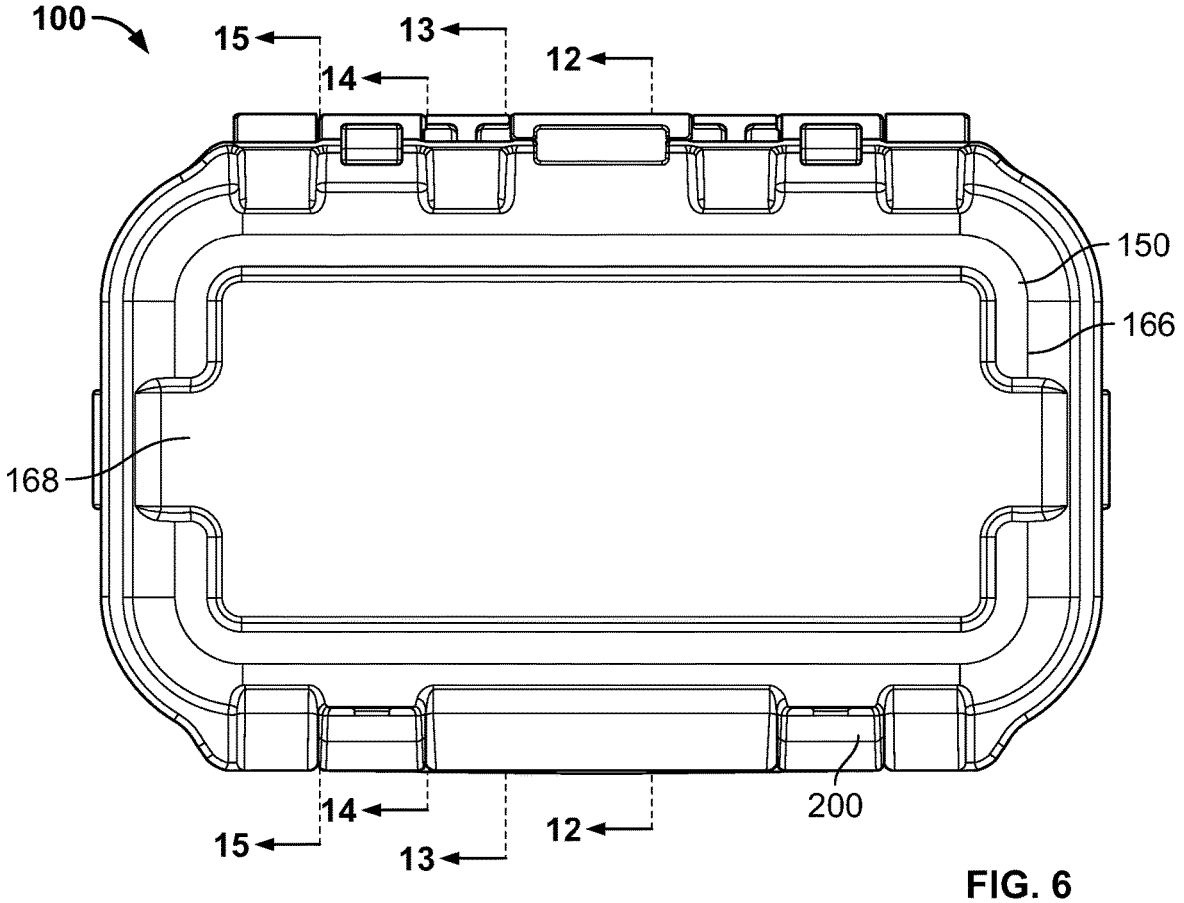
FIG. 6 illustrates a top view of the container of FIG. 1 in a closed configuration with some components removed for clarity according to one or more aspects described herein.
Figure 7:
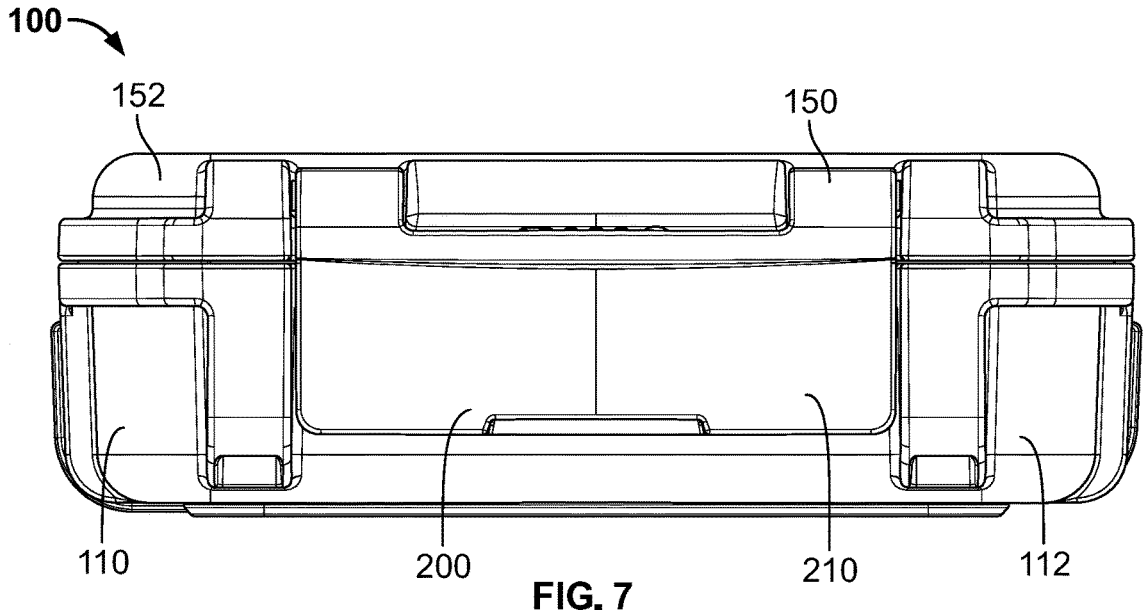
FIG. 7 illustrates a front view of the container of FIG. 1 in a closed configuration with some components removed for clarity according to one or more aspects described herein.
Figure 8:
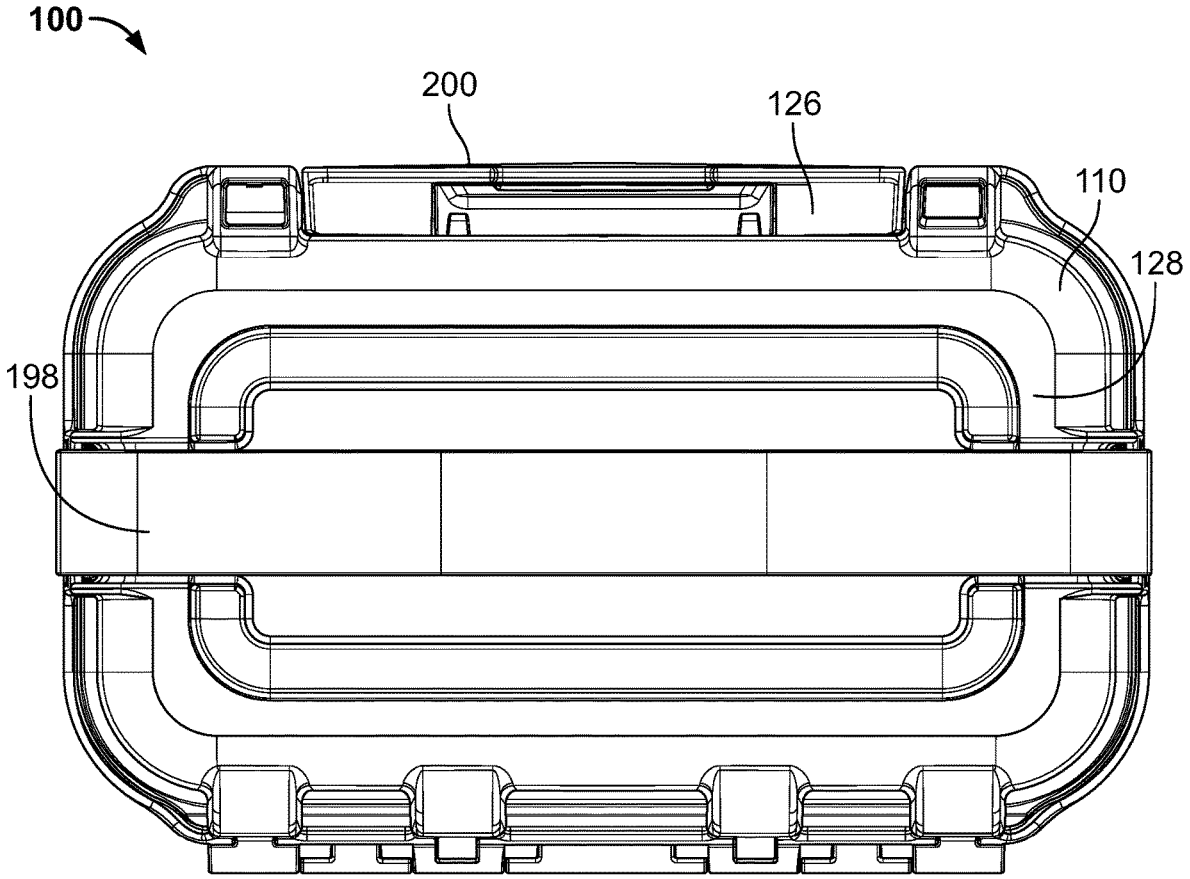
FIG. 8 illustrates a bottom view of the container of FIG. 1 in a closed configuration with some components removed for clarity according to one or more aspects described herein.
Figure 9:
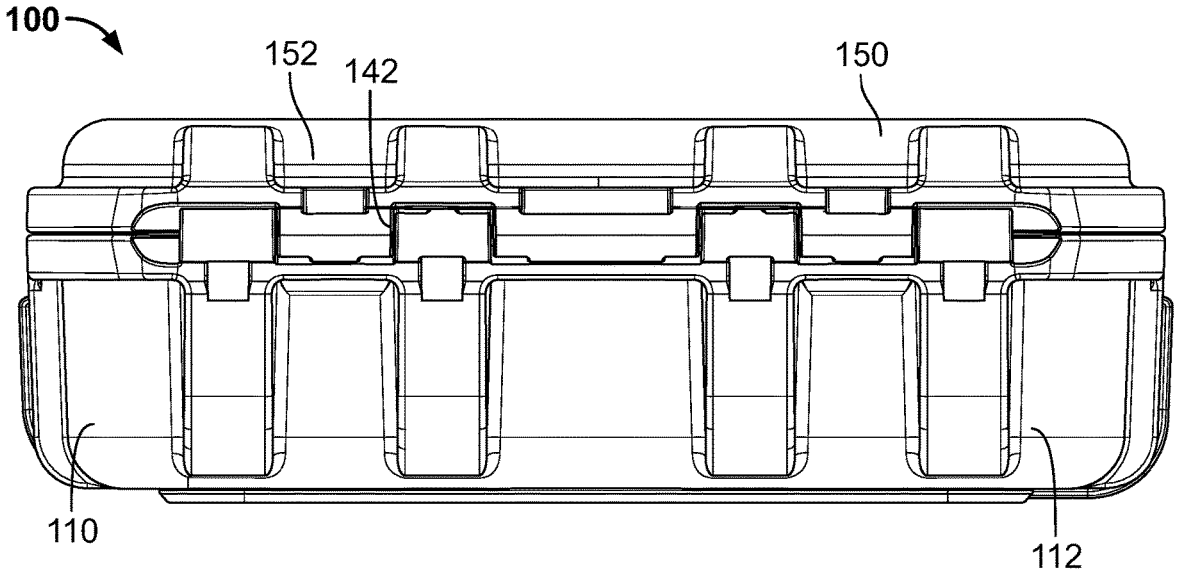
FIG. 9 illustrates a rear view of the container of FIG. 1 in a closed configuration with some components removed for clarity according to one or more aspects described herein.
Figure 10:
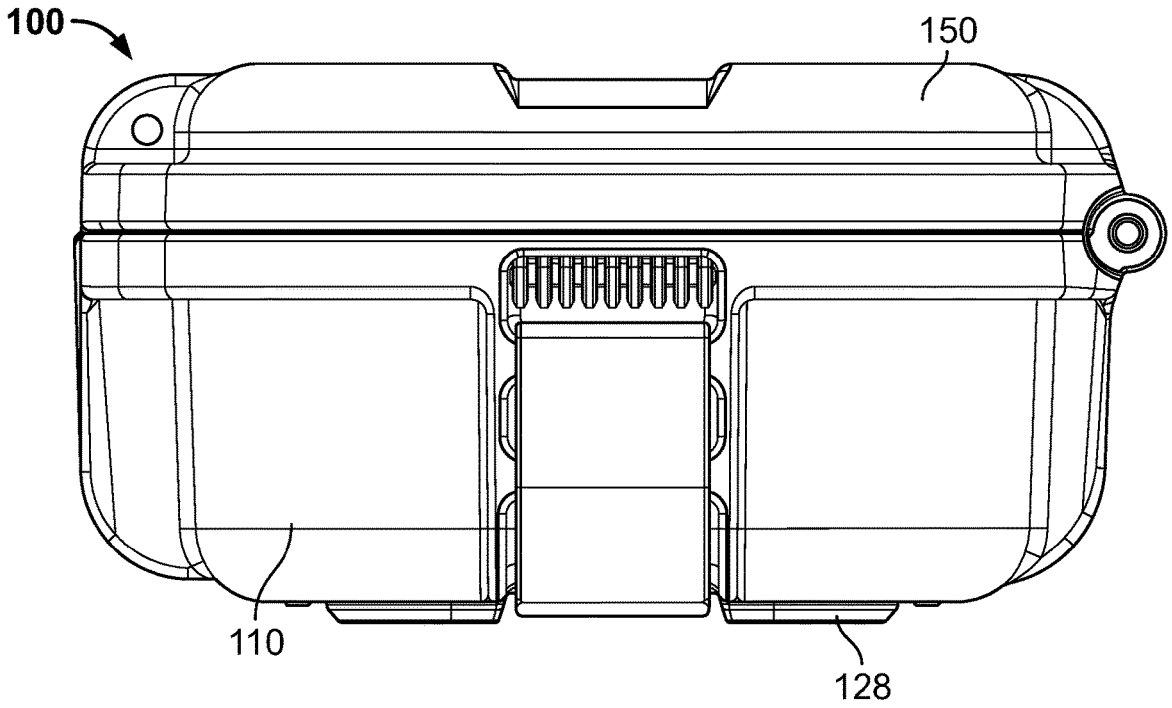
FIG. 10 illustrates a right side view of the container of FIG. 1 in a closed configuration with some components removed for clarity according to one or more aspects described herein.
Figure 11:
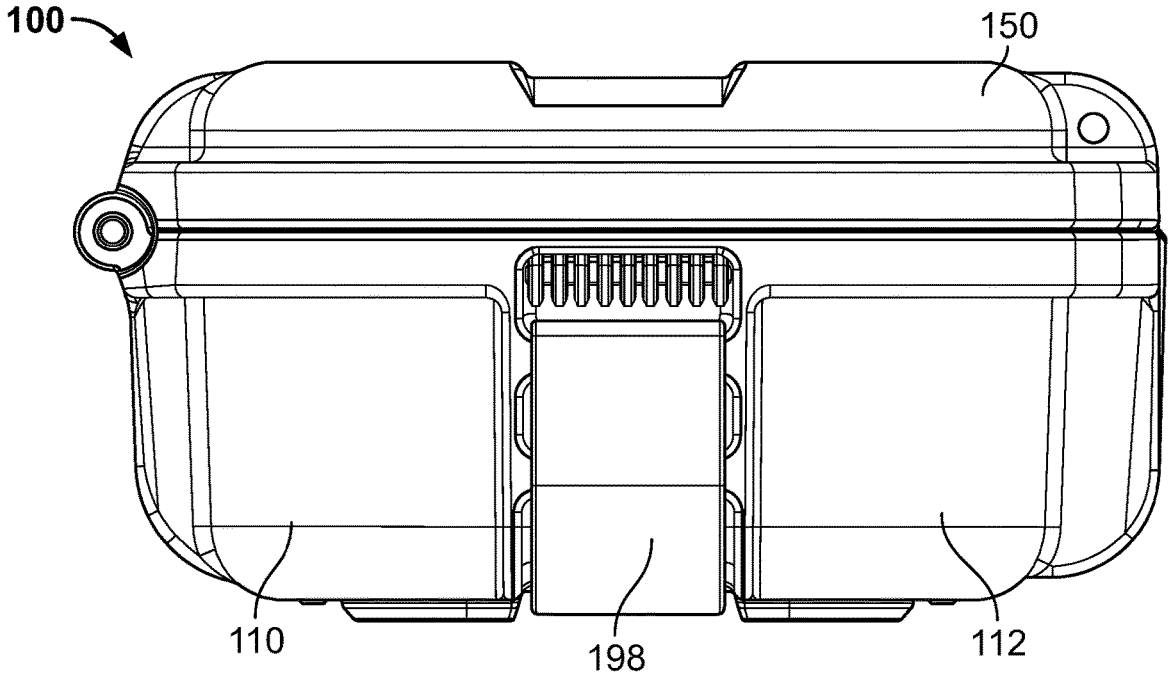
FIG. 11 illustrates a left side view of the container of FIG. 1 in a closed configuration with some components removed for clarity according to one or more aspects described herein.

The base 110 may include a base opening 130 at the second end 124 of the base sidewall structure 112 (shown in FIGS. 3-5). The base opening 130 is configured to allow access to a base interior void 132 formed by the base sidewall structure 112 and the bottom portion 126.

The container 100 may include a lid 150. The lid 150 may be pivotally connected to the base 110 and be configured to rotate between an open configuration and a closed configuration, where the open configuration allows access to the base opening 130 and the base interior void 132 and the closed configuration prevents access to the base opening 130 and the base interior void 132. In some examples, rotating the lid 150 from the closed configuration to the open configuration includes rotating the lid about 90° from the closed configuration, or about 180° from the closed configuration, or about 270° from the closed configuration. As shown in FIG. 1, the base opening 130 may be covered by lid 150, when the container 100 is in a closed configuration. In some arrangements, the lid 150 may connect to the base 110 in a closed configuration using a press fit. Additionally, or alternatively, other securing systems or devices may be used to secure the lid 150 to the base 110, as will be discussed more fully herein.

In some examples, the lid 150 may be hinged such that it is connected to (either removably or permanently) the base 110 at a hinge 142 and may be rotated about the hinge 142. The hinge 142 may be one of various types of hinges, including a continuous piano hinge, double hinge, ball joint hinge, living hinge, and the like. These and various other hinge arrangements may be discussed more fully herein. The hinge 142 may permit the lid 150 to be opened and rotated away from the base 110, to allow access to the base interior void 132 defined by the base 110 (e.g., via base opening 130). That is, the hinge 142 may facilitate rotation of the lid 150 from a closed configuration of the container 100 (e.g., when the lid 150 is in place covering the base interior void 132 formed by the base 110, as shown in FIG. 1) to an open configuration (e.g., when the lid 150 is not covering the base interior void 132 formed by the base 110, as shown in FIGS. 3-5), and vice versa.

The lid 150 may include an lid sidewall structure 152 having a first side 154, a second side 156 opposite the first side 154, a third side 158 extending between an edge of the first side 154 and an edge of the second side 156, and a fourth side 160 opposite the third side 158. The lid sidewall structure 152 may also include a first end 162 and a second end 164 with an upper portion 166 connected to the second end 164 of the lid sidewall structure 152. The upper portion 166 may be configured to act as a cover for the container 100 that could support items placed on top of the container 100. In some examples, the upper portion 166 may have a centrally located recess 168 along the upper portion to allow a second container to be placed on top of the upper portion 166. The lid 150 may further include a lid opening 170 at the first end 162 of the lid sidewall structure 152. The lid opening 170 is configured to allow access to a lid interior void 172 formed by the lid sidewall structure 152 and the upper portion 166 at the second end 164 of the lid sidewall structure 152. In most examples, a height of the lid sidewall structure 152 may be less than a height of the base sidewall structure 112. Thus, the volume of the base interior void 132 may be larger than the volume of the lid interior void 172.

In some arrangements, the container 100 may include a gasket 199 or other sealing device. The gasket 199 may be arranged in either the lid 150 or the base 110 and may aid in sealing the lid 150 and base 110 when the lid 150 is in a closed configuration. For example, in one example, the container 100 may be manufactured such that it is dust tight when tested for 8 hours and/or waterproof when tested for 30 minutes under 1 meter of water. In some embodiments, the container 100 may be capable of achieving an IP68 (as set forth by International Electrotechnical Commission) rating which specifies that there is no ingress of dust or complete protection from dust when tested for 8 hours and ingress of water in harmful quantities is not possible when the enclosure is immersed in water under defined conditions of pressure and time (at 1 meter of submersion). The IP68 dust test is 8 hours long and the enclosure is tested in a vacuum. The IP68 water test is 30 minutes long and the enclosure is tested with the lowest point of the enclosure 1 meter deep water.

Figure 12:
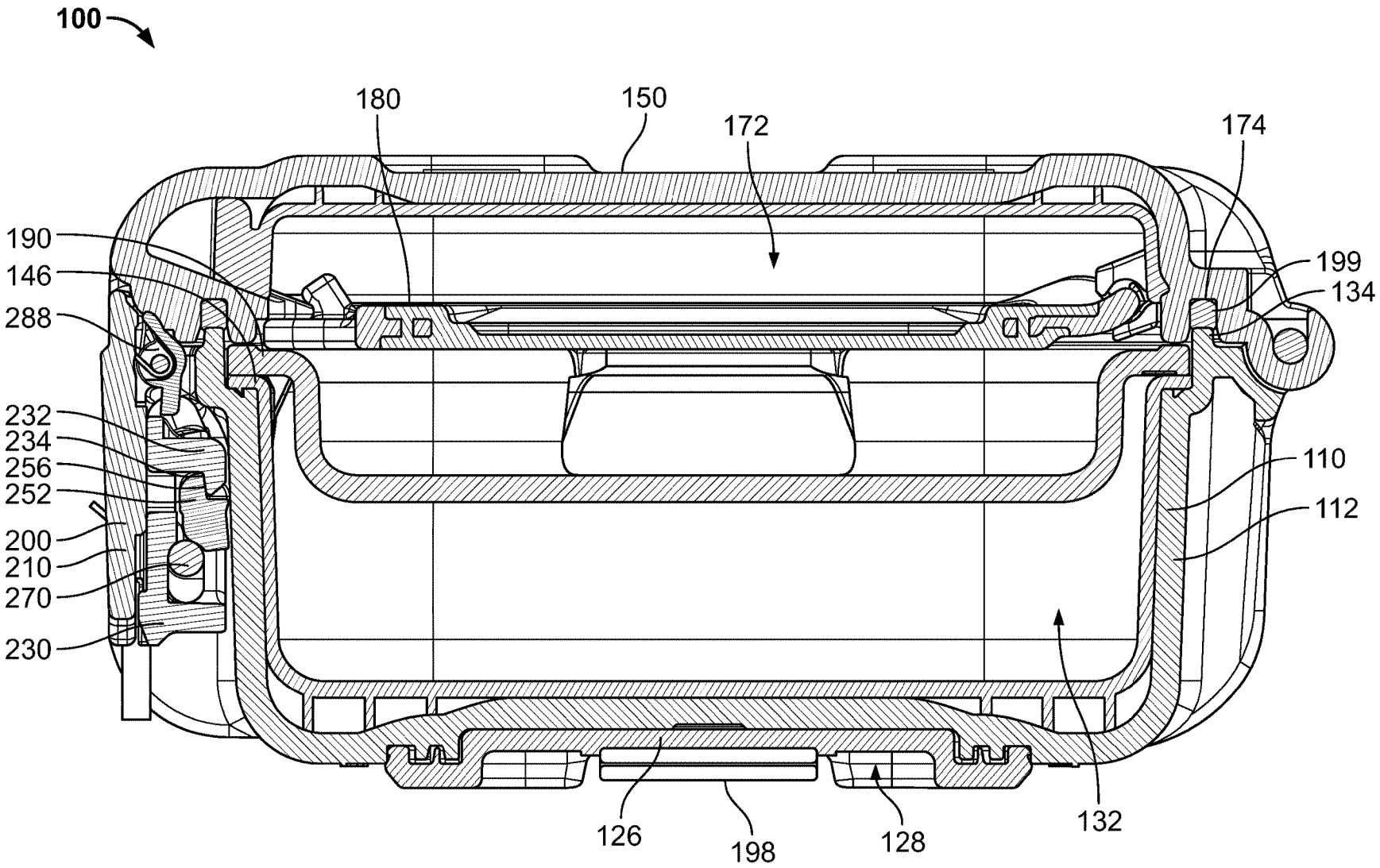
FIG. 12 illustrates a side cross-sectional view of the container of FIG. 1 along line 12-12 according to one or more aspects described herein.
Figure 13:
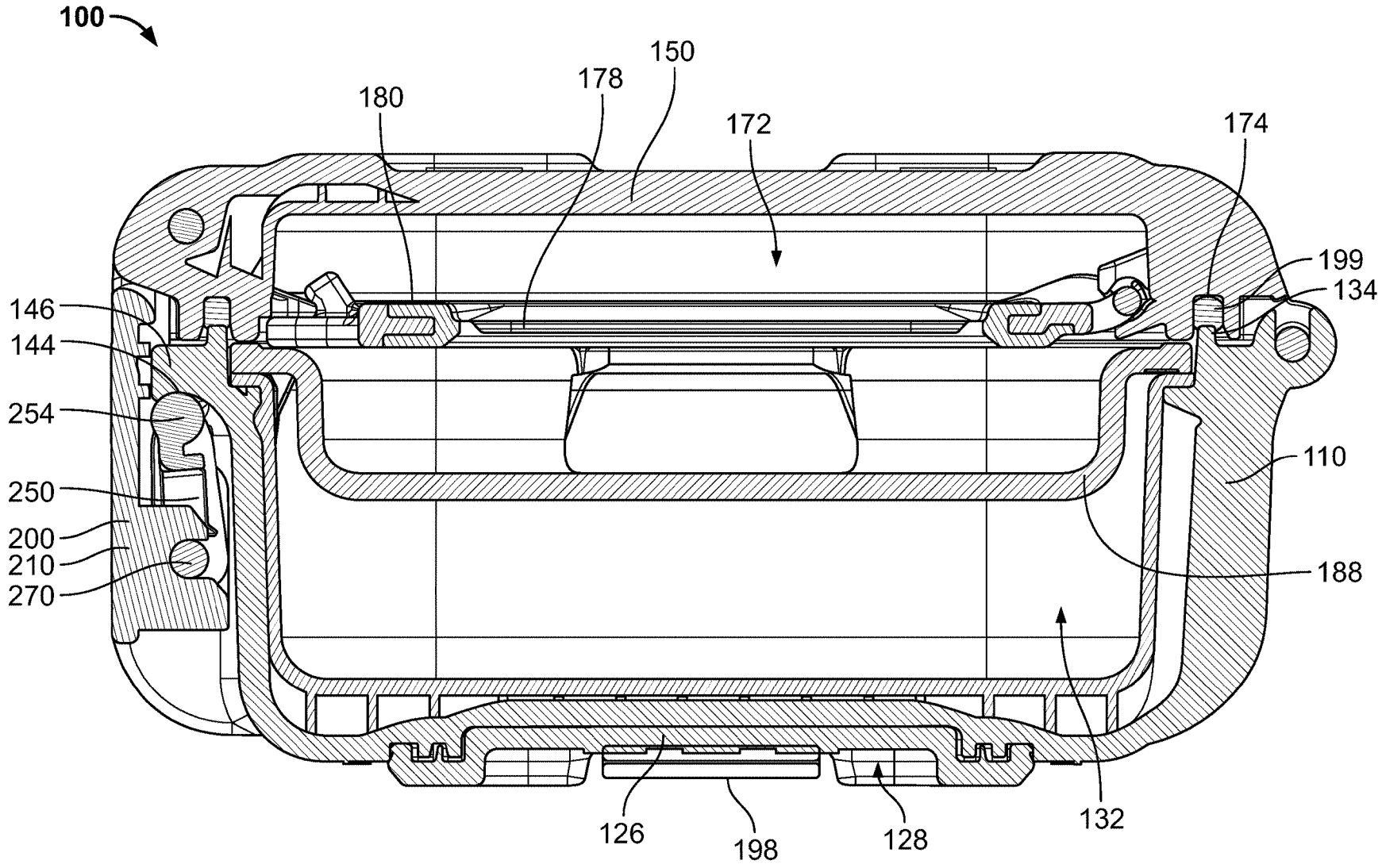
FIG. 13 illustrates a side cross-sectional view of the container of FIG. 1 along line 13-13 according to one or more aspects described herein.
Figure 14:
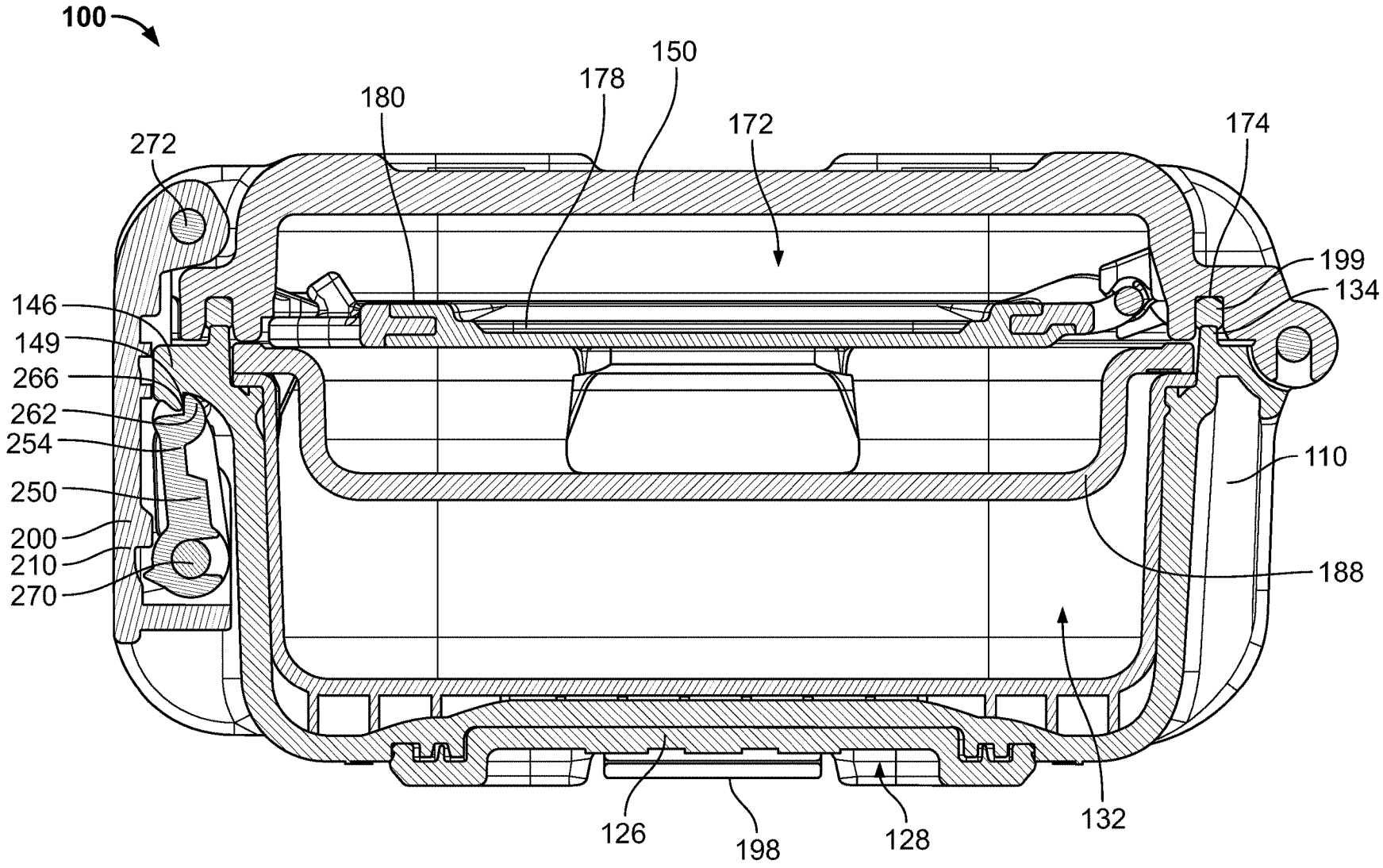
FIG. 14 illustrates a side cross-sectional view of the container of FIG. 1 along line 14-14 according to one or more aspects described herein.

In some examples, (and as best shown in FIGS. 12-14) the gasket 199 may be seated in a recess 174 formed in the lid 150 that extends around a perimeter of the lid 150. Additionally, in some examples, the container 100 may include a ridge 134 in the base 110 extending around a perimeter of the base 110. The gasket 199 may be placed between the recess 174 and the ridge 134. When the lid 150 is in a closed configuration, the ridge 134 having a shape corresponding to recess 174 may contact the gasket 199 and compress the gasket 199 and aid in sealing the lid 150 and the base 110 in the closed configuration as shown in FIGS. 12-14. In some examples, the gasket 199 may be a traditional gasket having a substantially circular cross section. In other arrangements, the gasket 199 may include strategically placed cut-outs that may reduce or eliminate a need for a vent (e.g., a vent to prevent lid lock). The gasket 199 may aid in maintaining a seal between the interior of the container 100 and the outside environment, and in some examples, the gasket 199 may aid in maintaining the temperature of the articles contained within the container 100. Alternatively, the gasket 199 may be arranged in a recess or channel formed in the base 110.

Figure 2:
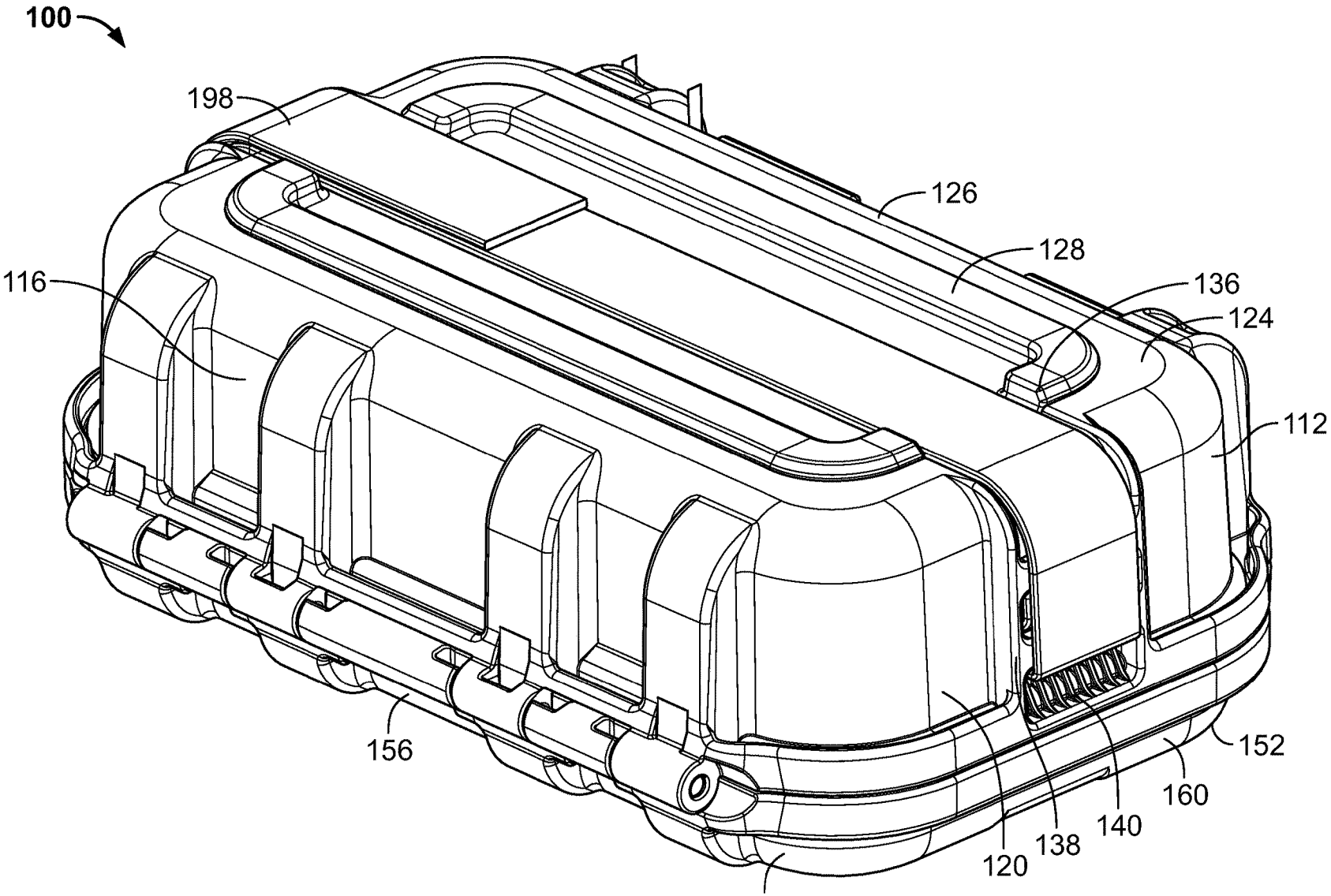
FIG. 2 illustrates a bottom perspective view of the container of FIG. 1 in a closed configuration according to one or more aspects described herein.

The container 100 may include additional features, such as a lanyard 198, shown in FIG. 2, to allow a user to carry the container 100 or attach the container 100 to other objects. The lanyard 198 may connect to the base on the third side 118 to the fourth side 120 and extends along the bottom portion 126. As shown in the illustrated example, the support member 128 may have a groove 136 (or pair of grooves) that receives and guide the lanyard 198 along the bottom portion 126. In addition, the third side 118 and fourth side 120 of the base sidewall structure 112 may include guide rails 138 to engage and guide the lanyard 198 along the third and fourth sides 118, 120. The base sidewall structure 112 may also include connecting members 140 adjacent the guide rails 138 to secure the lanyard 198 to the base 110 of container 100. The guide rails 138 and connecting members may be integrally formed with the base 110.

As shown in FIGS. 3, 4, 5, and 12-15, the lid 150 may include a divider 178 that is pivotally connected to an interior portion of the lid 150 to separate any items that may be stored in a lid interior void 172 from the base interior void 132. The divider 178 may extend across the lid opening 170 separating the base interior void 132 from the lid interior void 172. The divider 178 may have a front side 179 and a rear side 180 and an integrated hinge 181 formed along a first side 182 that is pivotally connected to the lid 150 at a hinge receiver 175 of the lid 150. The integrated hinge 181 may include a plurality of apertures spaced from the edge of the first side 182. In addition, the integrated hinge 181 may be located on an angle to the front side 179 and may be snap-fit into a hinge receiver 175 of the lid 150 to secure the divider 178 to the lid 150. As such, the divider 178 is releasably secured to the lid 150. The divider 178 may include a plurality of elongated openings 184. The elongated openings 184 may extend across a portion of the divider 178 in a direction generally oriented from the first side 182 to a second side 183 opposite the first side 182. Each elongated opening 184 may have a length, L, extends at least 50 percent of the width, W, of the divider 178, or between a range of 55 percent and 80 percent of the width, where the width, W, is the distance from the first side 182 to the second side 183. Alternatively, the divider 178 may be a continuous surface without openings.

Figure 15:
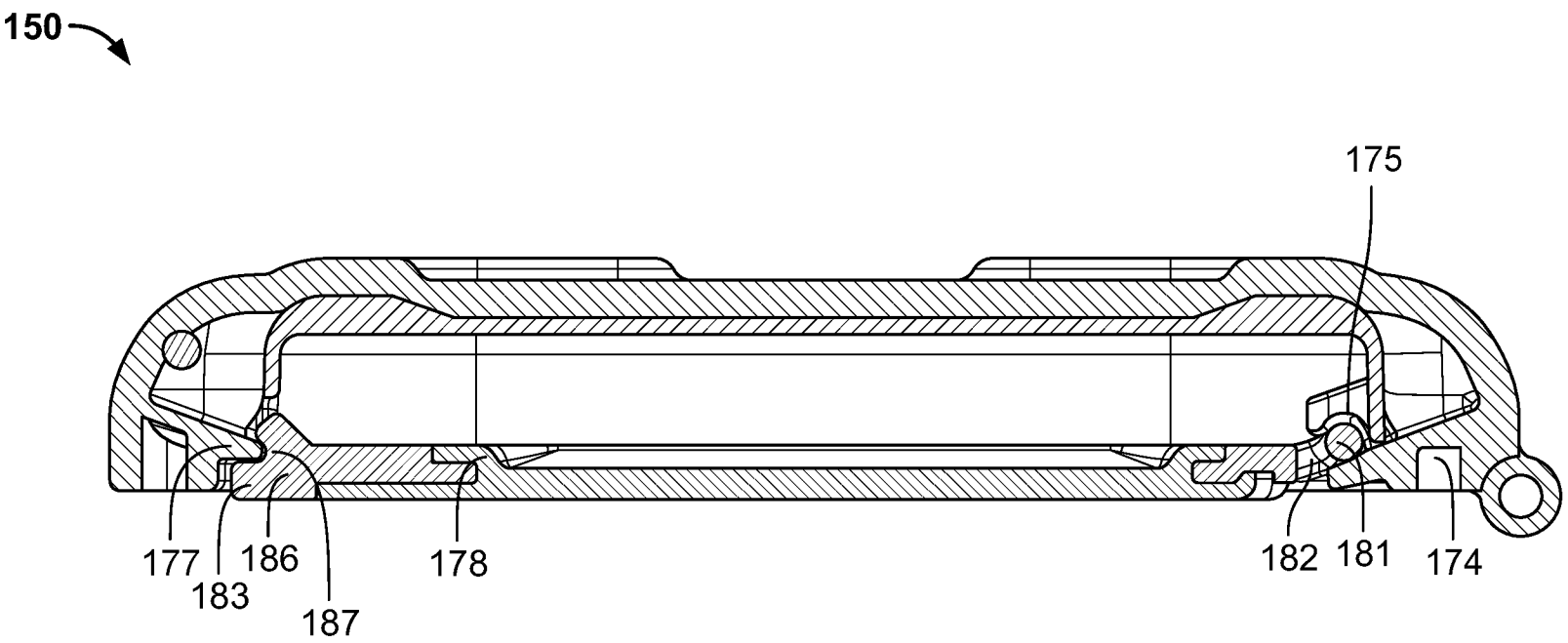
FIG. 15 illustrates a side cross-sectional view of the lid and divider of the container of FIG. 1 along line 15-15 according to one or more aspects described herein.

When the divider 178 is installed, the second side 183 of the divider 178 may be selectively secured to the lid 150 to prevent rotational movement of the divider 178 as best illustrated in FIG. 15. The divider 178 may include a central recess 185 along the second side 183 forming a pair of tabs 186. Each tab 186 may have an engagement receiver 187 that forms a friction or snap fit with a lid engaging member 177 that extends from an interior surface of the lid 150. The lid engaging member 177 may fit into a groove formed by the engagement receiver 187 of the divider 178.

The container 100 may also include a removable tray 188. The tray 188 may allow another level for a user to store items in the container 100. The tray 188 rests along a shelf 148 that extends along an inner perimeter of the base interior void 132. The tray 188 may include an upper ledge 190 with a perimeter wall 192 that extends from an inner edge 194 of the upper ledge 190 to a bottom wall 196 forming the bottom portion of the tray 188. The volume formed by the perimeter wall 192 and the bottom wall 196 of the tray may form an upper storage region of the base interior void 132. The tray 188 may have a tray depth that is less than a depth of the base sidewall structure 112 of the base 110 such that the bottom wall 196 of the tray 188 is spaced from the bottom portion 126 of the base 110, which allows for a secondary storage region within the base interior void 132 underneath the bottom wall 196 of the tray 188. As noted, since the tray 188 is removable, with the tray 188 removed, the base interior void 132 may form a single storage region within the base 110.

The upper ledge 190 may be continuous along the perimeter wall 192 to form a solid upper ledge 190. Similarly, the perimeter wall 192 and the bottom wall 196 may be continuous such that no holes or apertures are present in the tray 188. Alternatively, the perimeter wall 192 and/or the bottom wall 196 may include apertures. In some examples, the shelf 148 may be continuous along the inner perimeter of the base interior void 132, while in other examples, the shelf 148 may be interrupted or a plurality of mounts (not shown) may be positioned along an interior surface of the base sidewall structure 112 such that the mounts form a planar surface to support the tray 188.

The divider 178 and the tray 188 may have an elastomeric material coating to provide a soft touch and feel and for storing delicate objects. This divider 178 and/or the tray 188 may be overmolded onto a more rigid base, or in some cases, the divider 178 and/or the tray 188 may be formed from an elastomeric material. The elastomeric materials used to form, or partially form, an exemplary divider 178 and/or tray 188 may materials such as or including natural and synthetic rubbers, thermoplastic urethanes (TPU), thermoplastic elastomers (TPE), or other similar materials.

In some arrangements, the container 100 may also include a latch assembly 200. As best illustrated in FIGS. 16A-20, the latch assembly 200 may have a locked position and an unlocked position, where the latch assembly 200 is configured to lock the lid 150 when the lid 150 is in a closed configuration. The latch assembly 200 may include a latch body 210 that is pivotally connected to the lid 150, a latch button 230 that is slidably connected to the latch body 210, and a latch-locking arm 250 pivotally connected to the latch body 210 around a latch pin 270 that is connected to the latch body 210. The latch assembly 200 may also include a latch button biasing member 280 that exerts a vertically oriented force onto the latch button 230, and a locking arm biasing member 282 that exerts a rotational force on the latch-locking arm 250. The latch button 230 may have a latch button-locking member 232, and the latch-locking arm 250 may have an arm-locking member 252. In some examples, the latch assembly 200 may further comprise an interlocking pawl 288 that is rotatably attached to the latch body 210 via a pin connection where the interlocking pawl 288 is located closer to an upper edge 212 of the latch body 210 than a lower edge 214 of the latch body 210. As will be described in more detail below, when the latch assembly 200 is moved to the locked position, the latch-locking arm 250 engages the base 110 and rotates against the rotational force of the locking arm biasing member 282 and the latch button 230 moves against the vertically oriented force of the latch button biasing member 280 until the latch button-locking member 232 engages the arm-locking member 252 as shown in FIGS. 16A-16D.

Figure 16A:
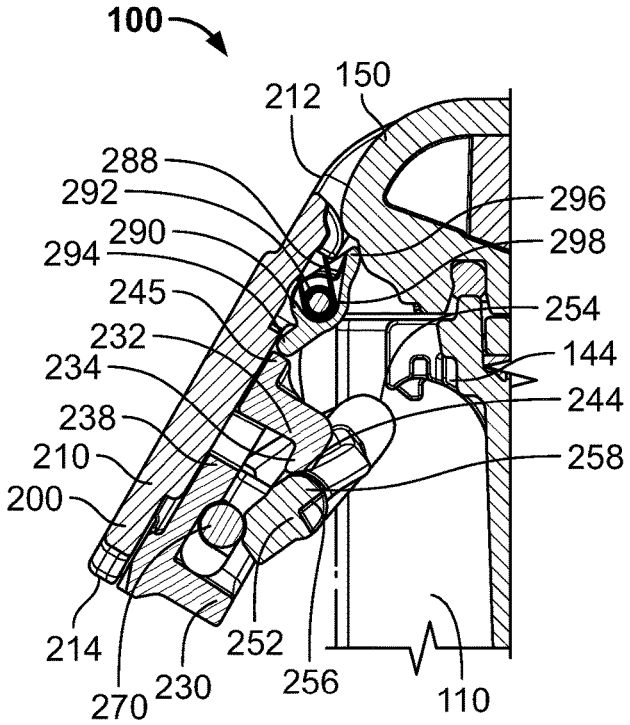
FIGS. 16A-16D illustrate partial cross-sectional views of a latch assembly of the container of FIG. 1 moving from an unlocked configuration to a locked configuration according to one or more aspects described herein.

FIGS. 16A-16D illustrates the movement of the latch assembly 200 from an unlocked position to a locked position. As shown in FIG. 16A, the latch assembly 200 is in an unlocked position with the latch-locking arm 250 extending away from the latch body 210 toward the base 110. The interlocking pawl 288 may prevent the latch-locking arm 250 from inadvertently engaging the latch button 230 into its locked position when the container 100 is in an open configuration (e.g., the base 110 and the lid 150 are separated from each other on at least one side). The interlocking pawl 288 may include a central member 290 with an aperture 292 extending through the central member 290, a first protrusion 294 extending outward from the central member 290, and a second protrusion 296 extending outward from the central member 290 opposite the first protrusion 294. The first protrusion 294 may contact the latch button 230 when the latch assembly 200 is in an unlocked position to prevent the latch button 230 from moving upward toward an upper edge 212 of the latch body 210. The second protrusion 296 of the interlocking pawl 288 may have a curved outer surface that may contact the lid 150 when the latch assembly 200 is in an unlocked position to prevent the latch-locking arm 250 from locking before the lid 150 is in the closed configuration. In addition, a pawl biasing member 298 may exert a rotational force on the interlocking pawl 288 to keep the interlocking pawl 288 in contact with the latch button 230 when the container 100 is in an open configuration. Since the latch button 230 cannot slide, the latch-locking arm 250 cannot rotate to inadvertently engage the latch button 230 prior to the lid 150 being closed onto the base 110. For example, the pawl biasing member 298 may be a torsion spring that exerts a rotational force to bias the first protrusion 294 toward the latch body 210 (i.e., a clockwise direction as shown in FIG. 16A). The rotary motion of the interlocking pawl 288 may be controlled by a cam-like interaction between the outer surface of the second protrusion 296 of the pawl 288 and the lid 150. In some examples, the corresponding engagement region 176 with a corresponding curved surface to engage the curved outer surface of the second protrusion 296.

Figure 16B:
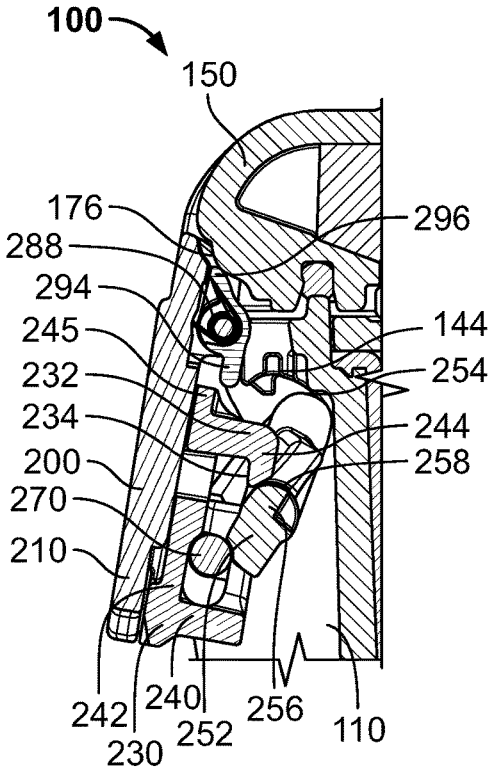
Figure 16C:
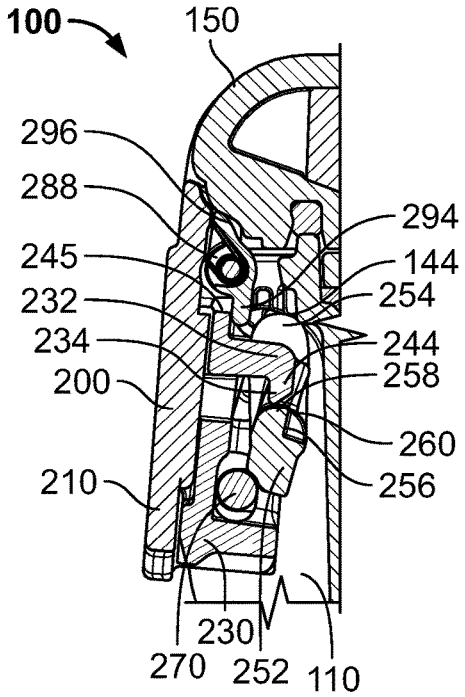

FIGS. 16B and 16C illustrate the latch assembly 200 engaging the base 110 causing the latch assembly 200 to begin to move from an unlocked position to a locked position. As a locking arm engaging member 254 of the latch-locking arm 250 engages a receiver 144 positioned under a lip 146 that extends outward along a first side 114 of the sidewall structure (as best shown in FIG. 13), the latch-locking arm 250 begins to rotate towards the latch body 210 (i.e., the latch-locking arm 250 rotates in a counterclockwise direction as shown in FIG. 16B). In some examples, the lip 146 may extend outward along an entire perimeter of the base 110. The receiver 144 may have a concave cross-sectional shape, and the locking arm engaging member 254 may have a convex shape cross-sectional shape. As the latch-locking arm 250 contacts the base 110, the latch-locking arm 250 begins to move underneath the base 110. The rotational movement of the latch-locking arm 250 may cause the latch button-locking member 232 to contact and ride up along an outer surface 258 of the arm-locking member 252. As the latch button-locking member 232 moves along the outer surface 258, the latch button 230 may translate upward in a sliding motion toward an upper edge 212 of the latch body 210. As the latch-locking arm 250 rotates, the entire latch assembly 200 rotates towards a vertical orientation.

Figure 16D:
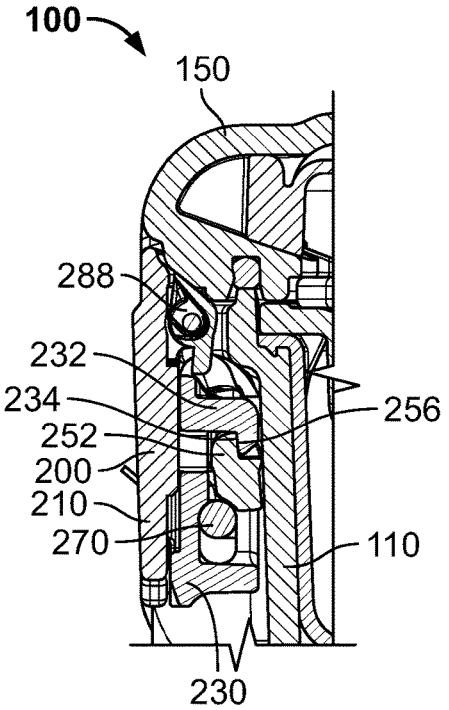

FIG. 16D illustrates the latch assembly 200 in a locked position. In the locked position, the latch button-locking member 232 engages the arm-locking member 252, where the latch-locking arm 250 is in a substantially vertical orientation. Each locking member 232, 252 may include a locking surface 234, 256 respectively that confront each other when the latch assembly 200 is in a locked position. Further, when in a locked position each locking surface 234, 256 may be substantially vertically oriented. As the latch button-locking member 232 moves the curved outer surface 258 of the arm-locking member 252, the latch button-locking member 232 eventually reaches an upper edge 260 of the curved outer surface 258. The upper edge 260 may also be the upper edge of the locking surface 256 such that once the latch button-locking member 232 passes the upper edge 260 of outer surface 258, the latch button-locking member 232 drops such that the locking surface 234 moves downward to confront the locking surface 256 of the arm-locking member 252.

Figure 17A:
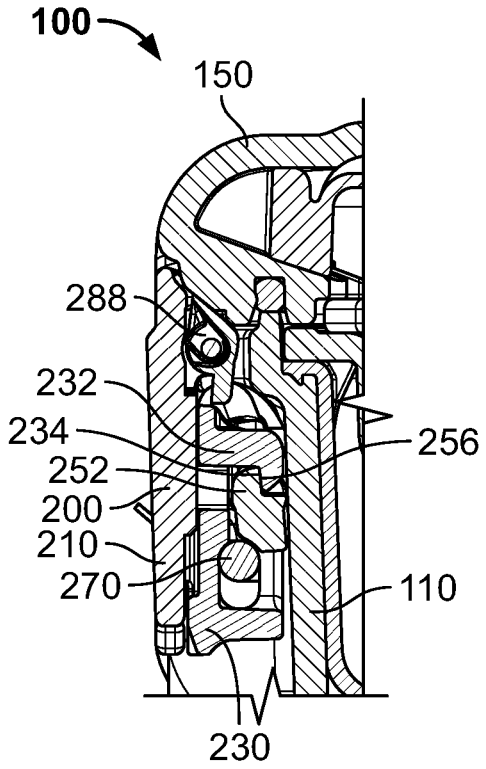
FIGS. 17A-17C illustrate partial cross-sectional views of a latch assembly of the container of FIG. 1 moving from a locked configuration to an unlocked configuration according to one or more aspects described herein.
Figure 17B:
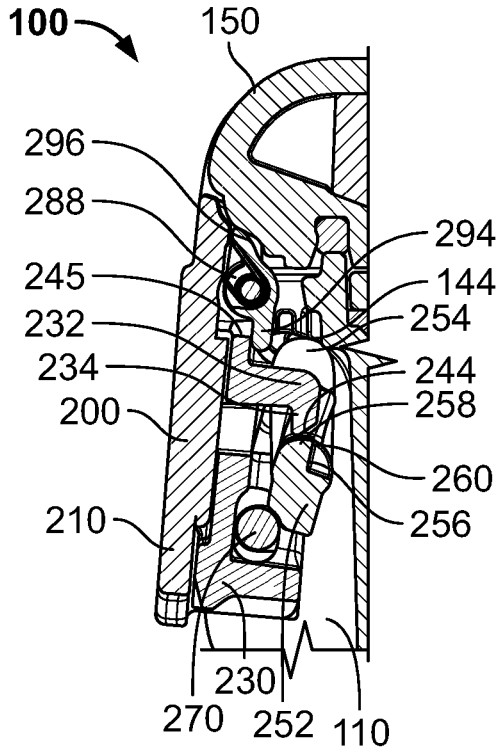
Figure 17C:
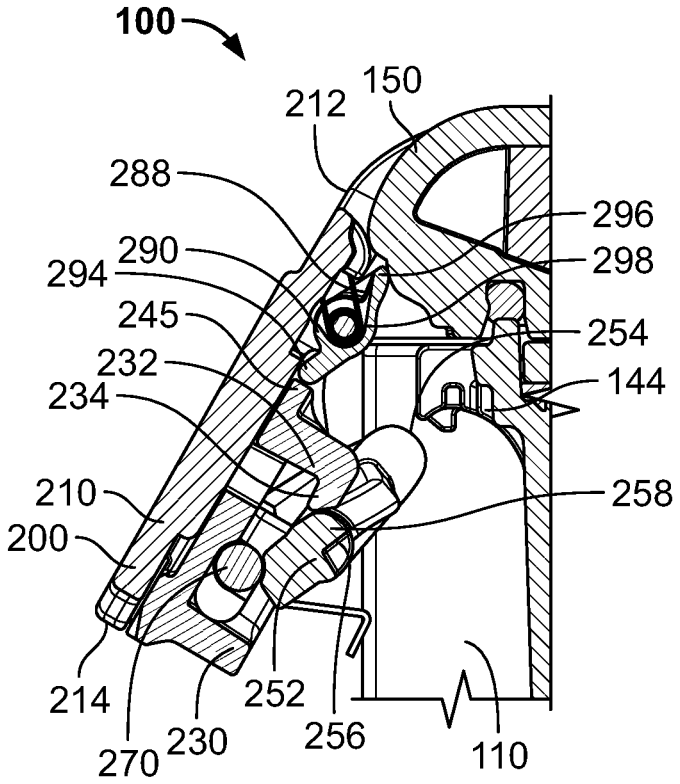

To move the latch assembly 200 from a locked position to an unlocked position, the above described process is reversed as shown in FIGS. 17A-17C. A user may push the latch button 230 upward where locking surface 234 disengages from locking surface 256. The locking arm biasing member 282 may then cause the latch-locking arm 250 to rotate towards the base 110 causing the latch button-locking member 232 to slide down the outer surface 258 of the arm-locking member 252. In addition, the latch button biasing member 280 exerts a downward force on the latch button 230 to help pull the latch button 230 and assist the latch button-locking member 232 to slide down the outer surface 258 of the arm-locking member 252. In some examples, the latch assembly 200 may operate without the interlocking pawl 288.

Figure 18:
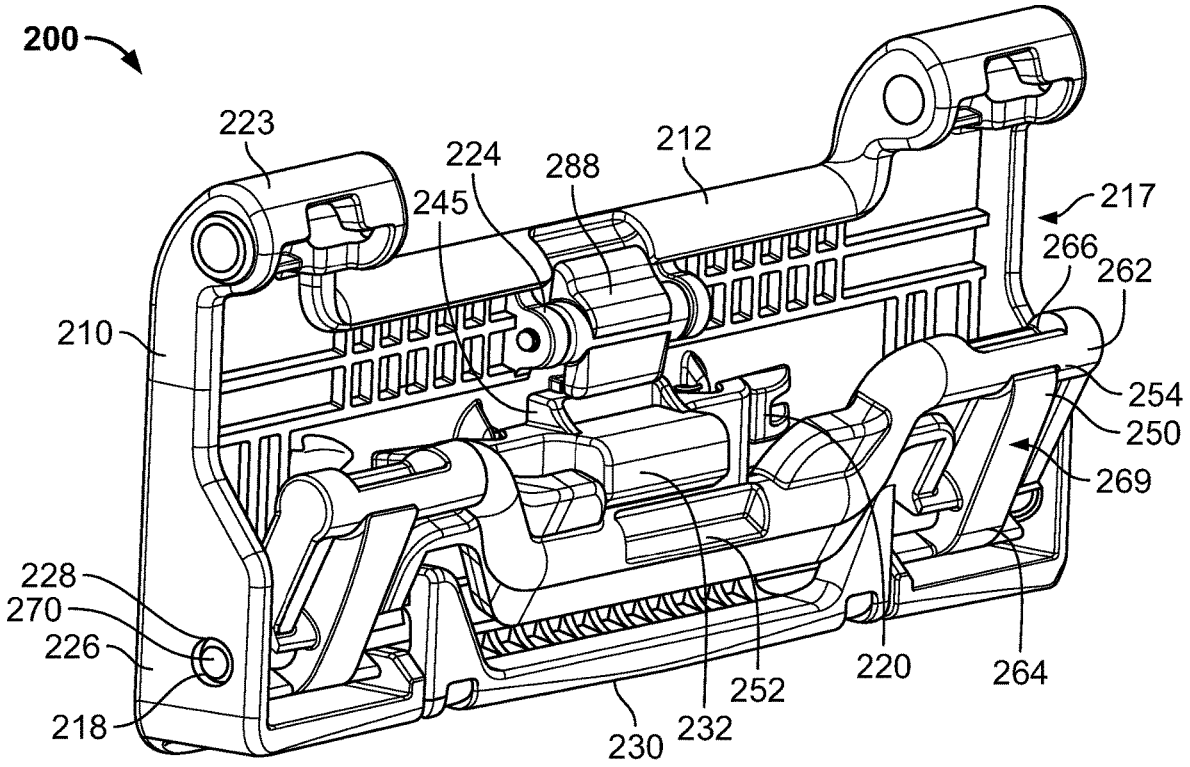
FIG. 18 illustrates a rear perspective view of a latch assembly of the container of FIG. 1 according to one or more aspects described herein.
Figure 19:
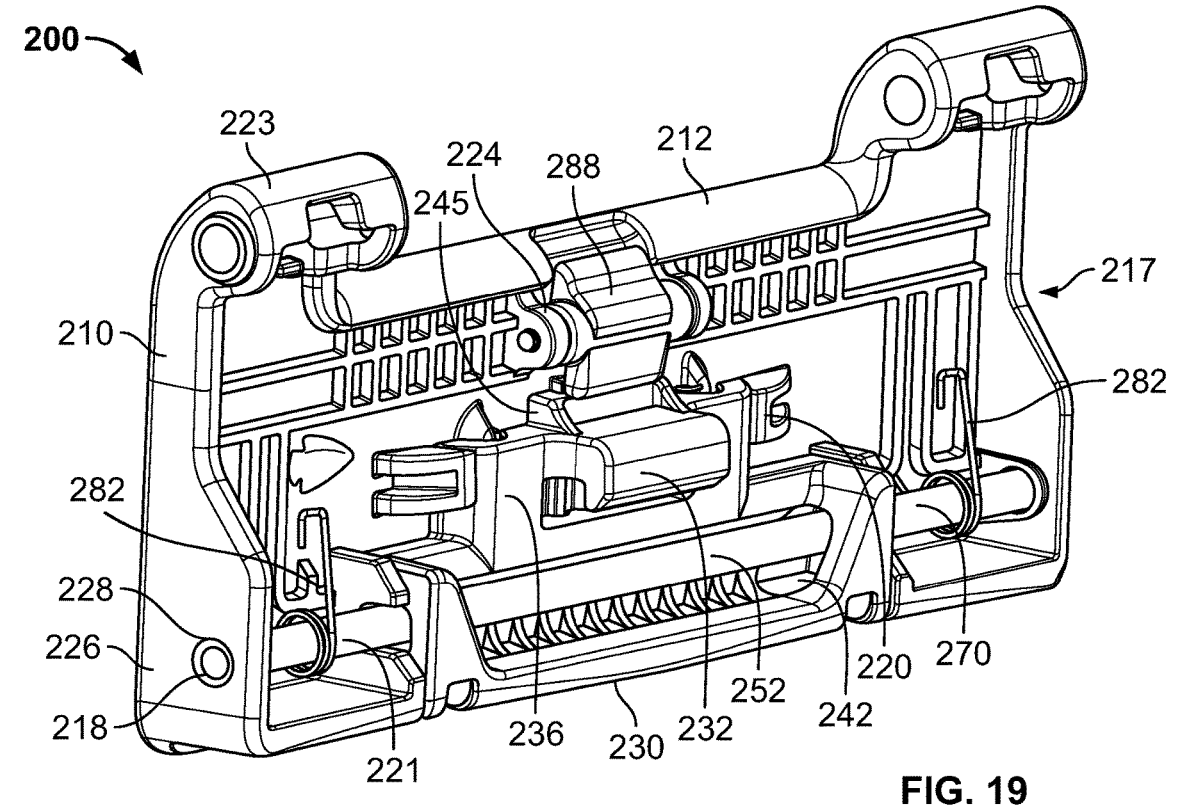
FIG. 19 illustrates a rear perspective view of the latch assembly of FIG. 18 with components removed according to one or more aspects described herein.
Figure 20:
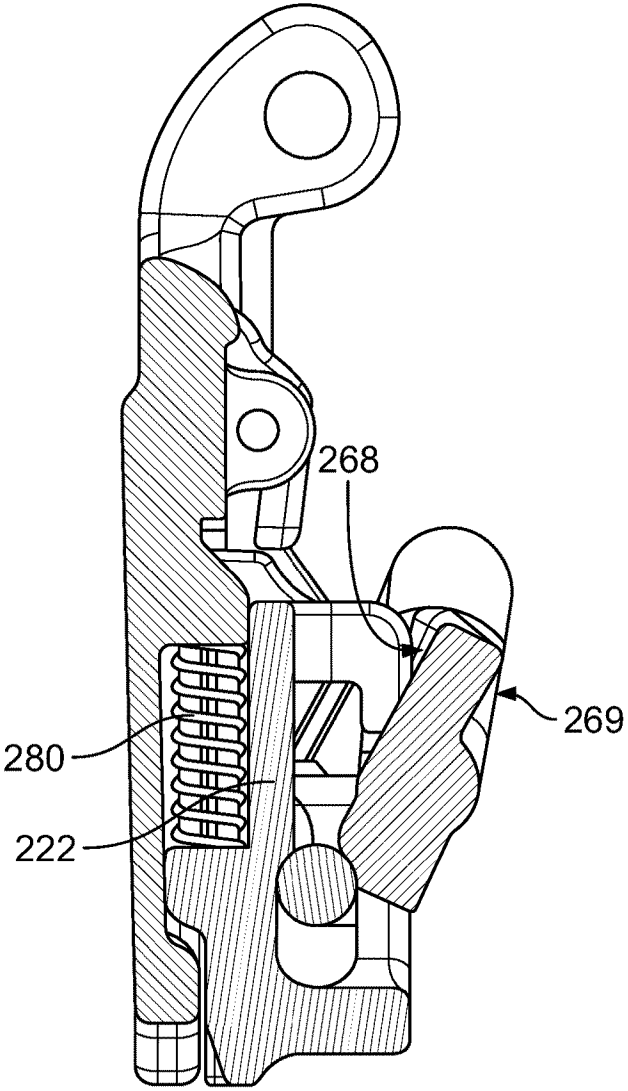
FIG. 20 illustrates a side cross-sectional view of the latch assembly of FIG. 18 according to one or more aspects described herein.

FIGS. 18-20 illustrate the latch assembly 200 disconnected from the lid 150. As discussed above, the latch assembly 200 may include a latch body 210, a latch button 230 that is slidably connected to the latch body 210, and a latch-locking arm 250 pivotally connected to the latch body 210 around a latch pin 270 that is connected to the latch body 210.

The latch body 210 may include an upper edge 212, a lower edge 214, and an outward facing surface 216 extending between the upper and lower edges 212, 214. On the inward side 217 opposite the outward facing surface 216, the latch body 210 may further comprise a pair of hinge members 223, a latch pin receiver 218, a pair of latch button guides 220, and a button biasing member receiver 222. The hinge members 223 may be configured to receive a lid latch pin 272 to connect the latch assembly 200 to the lid 150. A latch pin receiver 218 may include an aperture 228 arranged on a side surface 226 of the latch body 210 and also include a pin support 221 that receives the latch pin 270 on at least two sides. In addition, each latch button guide 220 may be a protrusion arranged on either side of the latch button 230 to keep the latch button 230 moving in a linear orientation. The button biasing member receiver 222 may comprise a recess or pair of recesses in the latch body 210 that are configured to hold a portion of the latch button biasing member 280. The latch button biasing member 280 may be a compression spring or pair of compression springs to exert a linear force toward the lower edge 214 onto the latch button 230. This linear force helps to keep the latch button-locking member 232 engaged with the arm-locking member 252. In an exemplary latch assembly 200 that includes an interlocking pawl 288, the latch body 210 may further include a pawl receiver 224 that receives a pin and a pawl biasing member 298.

The latch button 230 may include a latch button-locking member 232 that extends outward from a rear surface 236, while the front surface 238 may be configured to confront and slidably move along an interior surface of the inward side 217 of the latch body 210. The latch button 230 may further include a bottom surface 240 to provide an interface for a user to exert an upward force to disengage and/or engage the latch assembly 200. A latch button pin receiver 242 may be positioned above the bottom surface 240. The latch button pin receiver 242 may comprise an aperture that receives the latch pin 270. The latch button pin receiver 242 may have a height that is larger than a diameter of the latch pin 270 to enable the latch button 230 to slide along the latch body 210, while the latch pin 270 remains fixed to the latch body 210. For example, a height of the latch button pin receiver 242 may be two times greater than a diameter of the latch pin 270. In some examples, the height of the latch button pin receiver 242 may be within a range of 1.5 to 3 times greater than a diameter of the latch pin 270. As another feature, the front surface 238 may include a recess substantially aligns with the button biasing member receiver 222 in the latch body 210 that are configured to hold a portion of the latch button biasing member 280.

The latch button-locking member 232 may be centrally located on the latch button 230 and may include a locking surface 234 that extends substantially perpendicular to the bottom surface 240. The latch button-locking member 232 may include a slide surface 244 adjacent to a lower edge of the locking surface 234, where the slide surface 244 may be configured to slide along the outer surface 258 of the arm-locking member 252. The slide surface 244 may be arranged at an acute angle (i.e., within a range of 1 degree and 89 degrees) to the locking surface 234. In some examples, a stop 245 may extend from an upper surface 246 of the latch button 230, where the stop is configured to contact the interlocking pawl 288 to prevent the latch button 230 from inadvertently moving when the latch assembly 200 is in an unlocked position.

The latch-locking arm 250 may have a front side 268 that faces the latch body 210 and a rear side 269 that faces the base 110. The latch-locking arm 250 may include an arm-locking member 252 that is substantially centered along the latch-locking arm 250, a pair of locking arm engaging members 254 arranged on each side of the arm-locking member 252, and where each engaging member 254 may be spaced from the arm-locking member 252. Further, each engaging member 254 may have a free end 262 with a curved or convex cross-sectional shape that engages the receiver 144 on the base 110 and a fixed end 264 that receives the latch pin 270. As The locking arm biasing member 282 may be a torsional spring or a pair of torsional springs that is (are) connected to the latch pin 270 and exert a rotational force(s) on the engaging members 254. In addition, as shown in FIG. 14, the free end 262 of each engaging member 254 may include a locking surface 266 that may confront and contact a locking member 149 positioned in the receiver 144 of the base 110. The locking surface 266 may be substantially parallel to the locking surface 256 of the arm-locking member 252 and may be spaced forward (toward the latch body 210) from the locking surface 256.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A container comprising:

a base including:

a sidewall structure having at least a first side and a second side opposite the first side, the sidewall structure having a first end and a second end opposite the first end;

a bottom portion connected to the first end of the sidewall structure and configured to support the container on a surface; and a base opening formed at the second end of the sidewall structure, the base opening being configured to allow access to an interior void of the container formed by the sidewall structure and the bottom portion;

a lid pivotally connected to the base, wherein the lid is configured to rotate between an open configuration that allows access to the base opening and a closed configuration that prevents access to the base opening; and a latch assembly having a locked position and an unlocked position, the latch assembly comprising:

a latch body pivotally connected to the lid;

a latch-locking arm pivotally connected to the latch body;

a latch-locking arm biasing member that exerts a rotational force on the latch-locking arm;

an interlocking pawl that is rotatably attached to the latch body located closer to an upper edge of the latch body than a lower edge of the latch body, wherein the interlocking pawl is configured to contact the lid when the latch assembly is in the unlocked position to prevent the latch assembly from locking before the lid is in the closed configuration; and wherein when the latch assembly is moved to the locked position, the latch-locking arm engages the base and rotates against the rotational force.

2. The container of claim 1, where the latch assembly further comprises a latch button slidably connected with the latch body, the latch button having a latch button-locking member, wherein when the latch assembly is in the locked position the latch button engages the latch-locking arm.

3. The container of claim 2, wherein the latch button-locking member engages the latch-locking arm when the latch-locking arm is in a substantially vertical position.

4. The container of claim 1, wherein the latch-locking arm biasing member is a torsional spring.

5. The container of claim 2, wherein the latch-locking arm includes an arm-locking member, wherein the arm-locking member includes a first locking surface and a curved upper surface extending from an upper edge of the first locking surface.

6. The container of claim 5, wherein the arm-locking member is substantially centered along the latch-locking arm.

7. The container of claim 5, wherein the latch-locking arm has a pair of engaging members arranged on each side of the arm-locking member, and wherein each engaging member of the pair of engaging members is spaced from the arm-locking member.

8. The container of claim 7, wherein each engaging member of the pair of engaging members of the latch-locking arm has an end with a curved surface that engages a receiver positioned under a lip that extends along the first side of the base.

9. The container of claim 1, further comprising a divider that extends across a lid opening of the lid, wherein the divider is releasably connected to the lid.

10. The container of claim 9, wherein the divider includes a plurality of openings.

11. A container comprising:

a base including:

a sidewall structure having at least a first side and a second side opposite the first side, the sidewall structure having a first end and a second end opposite the first end;

a bottom portion connected to the first end of the sidewall structure and configured to support the container on a surface; and a base opening formed at the second end of the sidewall structure, the base opening being configured to allow access to an interior void of the container formed by the sidewall structure and the bottom portion;

a lid pivotally connected to the base, wherein the lid is configured to rotate between an open configuration that allows access to the base opening and a closed configuration that prevents access to the base opening; and a latch assembly having a locked position and an unlocked position, the latch assembly comprising:

a latch body pivotally connected to the lid;

a latch button slidably connected with the latch body, the latch button having a latch button-locking member;

a latch-locking arm having an arm-locking member;

a latch button biasing member that exerts a linear force on the latch button; and wherein when the latch assembly is moved to the locked position, the latch button moves against the linear force until the latch button-locking member engages the arm-locking member.

12. The container of claim 11, wherein the latch button-locking member engages the arm-locking member when the latch-locking arm is in a substantially vertical position.

13. The container of claim 12, wherein the latch-locking arm is pivotally connected to the latch body.

14. The container of claim 11, wherein the latch assembly further comprises an interlocking pawl that is rotatably attached to the latch body located closer to an upper edge of the latch body than a lower edge of the latch body.

15. The container of claim 14, wherein the interlocking pawl includes a central member with an aperture extending through the base, a first protrusion extending outward from the central member, and a second protrusion extending outward from the central member opposite the first protrusion.

16. The container of claim 15, wherein the first protrusion of the interlocking pawl is configured to contact the latch button when the latch assembly is in the unlocked position to prevent the latch button from moving upwards.

17. The container of claim 15, wherein the second protrusion of the interlocking pawl has a curved outer surface that is configured to contact the lid when the latch assembly is in the unlocked position to prevent the latch assembly from locking before the lid is in the closed configuration.

18. The container of claim 14, the latch assembly further comprising a pawl biasing member that exerts a rotational force on the interlocking pawl.

19. The container of claim 1, wherein the latch assembly further comprises a pawl biasing member that exerts a rotational force on the interlocking pawl.

20. The container of claim 9, wherein the divider is formed from an elastomeric material.

* * * * *